US005368442A

United States Patent [19]

Speer

[11] Patent Number: 5,368,442

[45] Date of Patent: Nov. 29, 1994

[54] AUTOMATIC VARIABLE DISCRETE PITCH MARINE PROPELLER

[75] Inventor: Stephen R. Speer, Spokane, Wash.

[73] Assignee: Nautical Development, Inc., Spokane, Wash.

[21] Appl. No.: 152,966

[22] Filed: Nov. 15, 1993

Related U.S. Application Data

[60] Continuation of Ser. No. 912,153, Jul. 10, 1992, abandoned, which is a division of Ser. No. 645,096, Jan. 24, 1991, Pat. No. 5,129,785, and a continuation-in-part of Ser. No. 376,112, Jul. 6, 1989, Pat. No. 5,032,057, which is a division of Ser. No. 216,014, Jul. 17, 1988, Pat. No. 4,929,153.

[51] Int. Cl.[5] ..... B63H 1/06

[52] U.S. Cl. ..... 416/167; 416/168 R

[58] Field of Search ..... 416/44A, 46, 89, 93AX, 167, 167X, 168AY

[56] References Cited

U.S. PATENT DOCUMENTS

| | | | |
|---|---|---|---|
| 1,389,609 | 9/1921 | Weiher | 416/89 |
| 1,986,752 | 1/1935 | Rorvik | 416/167 |
| 2,023,684 | 12/1935 | Hubbell | 416/44 A |
| 2,055,196 | 9/1936 | Fuchs | 416/168 A X |
| 2,694,459 | 11/1954 | Biermann | 416/46 |
| 2,949,966 | 8/1960 | Simshauser . | |
| 2,955,659 | 10/1960 | Daley | 416/93 A X |
| 2,988,156 | 6/1961 | Coleman . | |
| 3,177,948 | 4/1965 | Reid . | |
| 3,231,023 | 1/1966 | Marshall . | |
| 3,567,336 | 3/1971 | Bartha . | |
| 4,419,050 | 12/1983 | Williams . | |
| 4,599,043 | 7/1986 | Müller | 416/167 X |
| 4,792,279 | 12/1988 | Bergeron | 416/167 X |
| 5,022,820 | 6/1991 | Bergeron | 416/167 X |

FOREIGN PATENT DOCUMENTS

| | | | |
|---|---|---|---|
| 711847 | 10/1941 | Germany | 416/43 |

*Primary Examiner*—Edward K. Look
*Assistant Examiner*—Mark Sgantzos
*Attorney, Agent, or Firm*—Barry G. Magidoff

[57] ABSTRACT

A self-actuating variable pitch marine propeller which incorporates two or more blades which are rotatably connected to a central hub; the blades rotate relative to the hub center about the shank axis. In operation, the blades are biassed towards the lower pitch, both by mechanical means, such as a spring, and optionally also by hydrodynamic load means. As the propeller rotational speed increases, centrifugal forces act to move the blades towards the higher pitch position. In one alternative mode the hydrodynamic load also acts towards the higher pitch position. There is further provided a holding mechanism to retain or hold the blades at least preferably in the lower pitch position, the holding mechanism being so designed that at a sharply defined combination of parameters, including rotational speed and optimally hydrodynamic load acting on the blades, the holding mechanism is caused to be released and the blades permitted to move to a second higher pitch position.

15 Claims, 43 Drawing Sheets

AUTOMATIC VARIABLE DISCRETE PITCH MARINE PROPELLER

This is a continuation of 912,153 filed Jul. 10, 1992 now abandoned, which is a division of 645,096, filed Jan. 24, 1991, now U.S. Pat. No. 5,129,785 and a continuation-in-part of application Ser. No. 376,112, filed Jul. 6, 1989, now U.S. Pat. No. 5,032,057, which was a division of Ser. No. 216,014, filed Jul. 17, 1988 and now U.S. Pat. No. 4,929,153.

This invention relates to self-actuating variable pitch marine propellers wherein the blade pitch is automatically variable from one discrete pitch operational position to another operational position.

GENERAL OBJECTS

It is an object of the present invention to provide, especially for a marine propeller, dependable self-actuating means for pitch changing from at least one discrete operational position, for example, for shifting between a first, lower discrete pitch blade operational position, to another, higher pitch blade position, with changes in such boat operating conditions as engine RPM and boat speed and/or boat acceleration. It is a further object of the invention to provide dependable, self-actuating pitch-changing means that will change in response to achieving a predetermined boat speed, which varies based upon the rate of acceleration. It is yet another object of this invention to provide means to automatically change marine propeller pitch within the most optimal engine speed range, which is automatically changed dependent upon the load on the engine and on the propeller blades.

A still further object of this invention is to provide a self-actuated propeller blade pitch-shifting mechanism for shifting the blades into a defined or discrete pitch position in response to predetermined hydrodynamic and inertial conditions, and to avoid blade flutter and/or propeller RPM hunting during boat operation regardless of changes in blade hydrodynamic load on the propeller blade. It is yet another object of the present invention to provide for automatic pitch shifting in a replaceable propeller which is self-contained and thus capable of being interchanged with a fixed pitch propeller without otherwise modifying the engine or propeller drive system, and which includes flexible coupling between the drive shaft and propeller.

GENERAL DESCRIPTION OF THE INVENTION

This invention presents a self-actuating variable pitch marine propeller which incorporates two or more blades having cylindrical shafts which are rotatably connected to a central hub via cylindrical joints; the blades rotate about and translate radially, relative to the hub center, along the blade shaft, or shank, axis.

In operation, the blades preferably move radially outwardly from the hub center as they rotate from a lower to a higher pitch. The blades are biased towards the low pitch position, i.e. preferably radially inward, via mechanical design constraints in combination with, e.g., spring forces and/or hydrodynamic loads. As the propeller rotational speed (about the hub axis) increases, centrifugal forces so generated increase, and act on the blade mass to cause a force on the blades creating a radially outward force. This radially outward force, upon reaching a sufficient magnitude, causes the blades to move radially outward. A blade positioning mechanism connected between each blade and the hub, and located within the hub directs the blades to rotate, e.g., to a higher pitch angle as the blades move radially outward. There is further provided holding means to retain, or hold, the blades at least in one discrete pitch position; the holding means is designed such that at a sharply defined combination of parameters, including rotational speed and, optimally, hydrodynamic load on the blades, the blades are released and permitted to move to a second pitch position. The providing of a holding means to retain the blades in a discrete position makes this approach more viable because the shift in blade pitch position can be made to be more consistent and stable.

BRIEF DESCRIPTION OF THE DRAWINGS

A further understanding of the present invention can be obtained by reference to the preferred embodiments set forth in the illustrations of the accompanying drawings. These embodiments are merely exemplary, and are not intended to limit the scope of this invention. Each drawing depicting the operating mechanism of the propeller of this invention is within itself drawn to scale, but different drawings are drawn to different scales. Referring to the drawings:

FIG. 33*c* is a front view of the propeller blade in FIG. 32*a*;

DETAILED DESCRIPTION OF THE INVENTION

Figure 1:
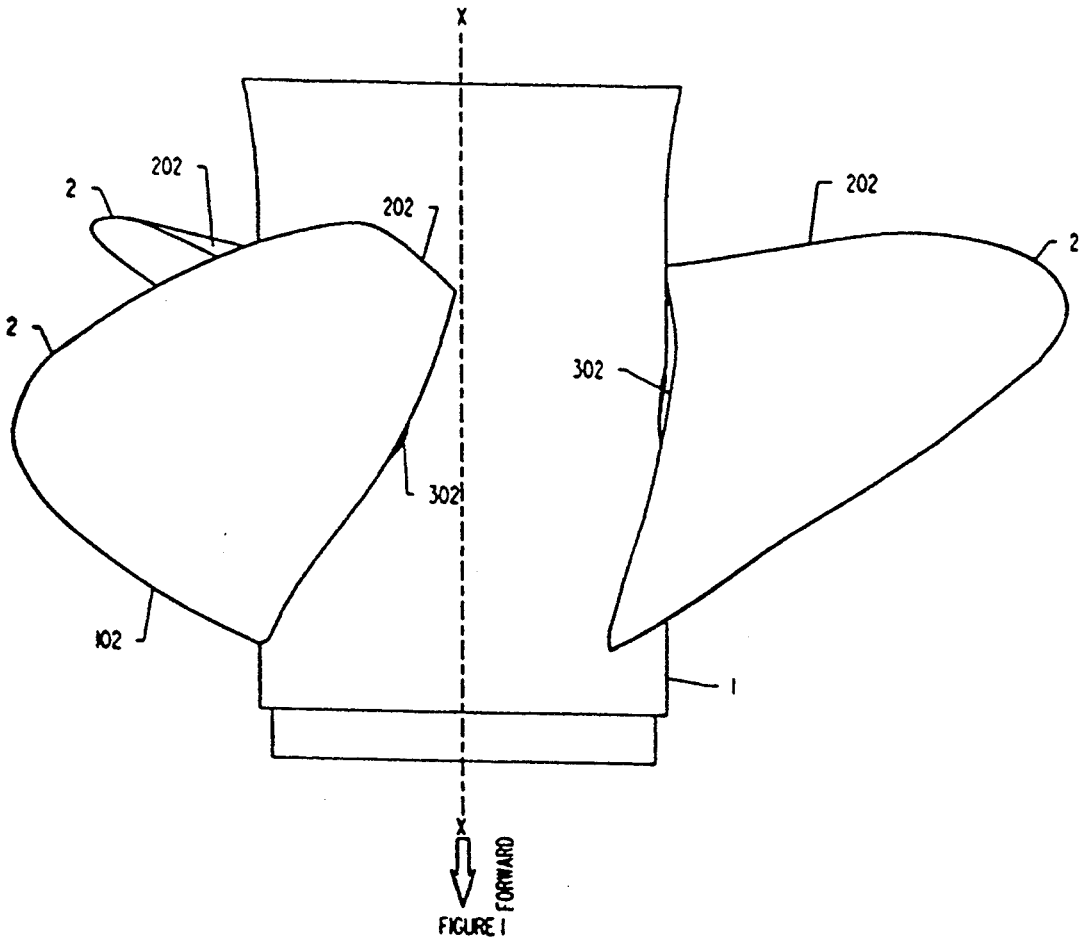
FIG. 1 is a side elevation view of the propeller assembly.
Figure 2:
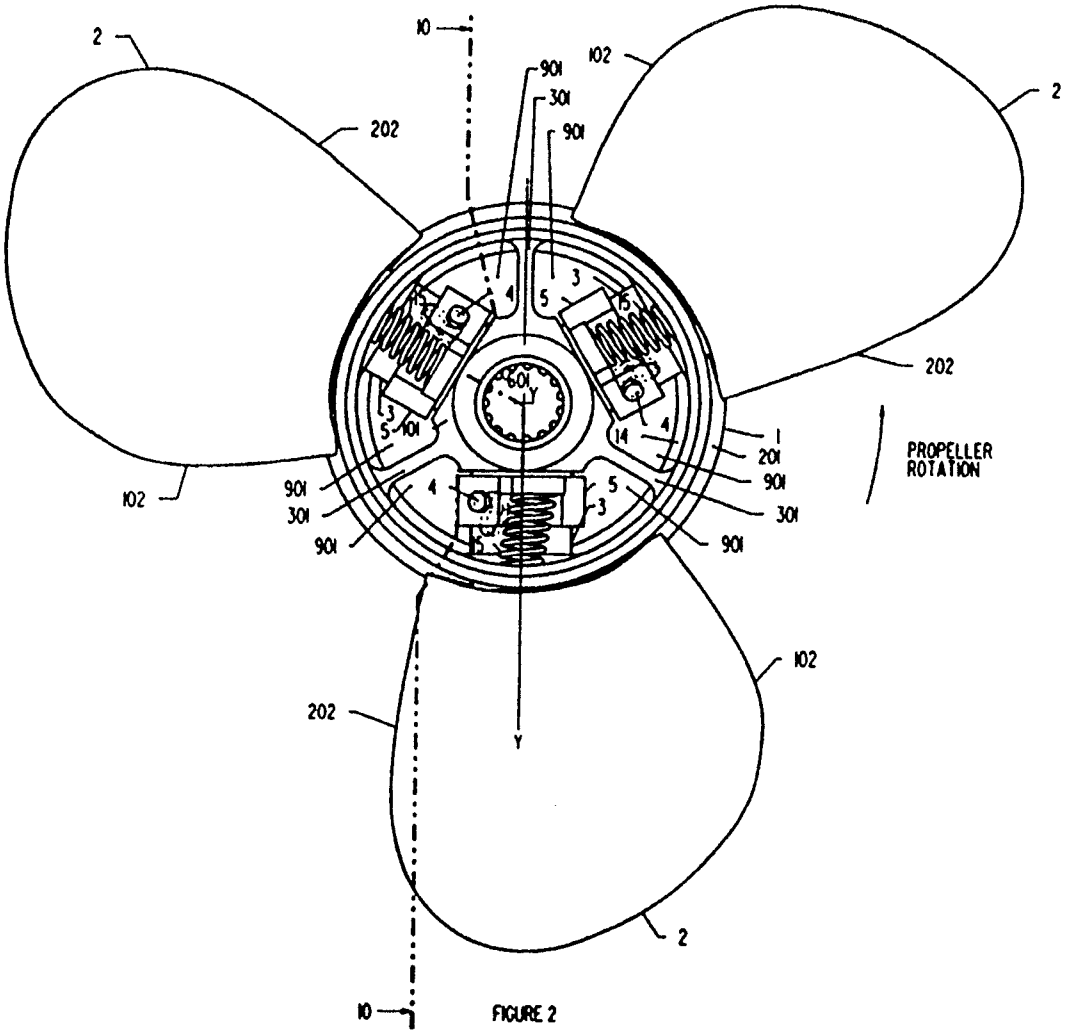
FIG. 2 is a front view of one embodiment of the propeller assembly having a rotating coordinating ring with the internal mechanism and blades located in the low pitch operational position.
Figure 3:
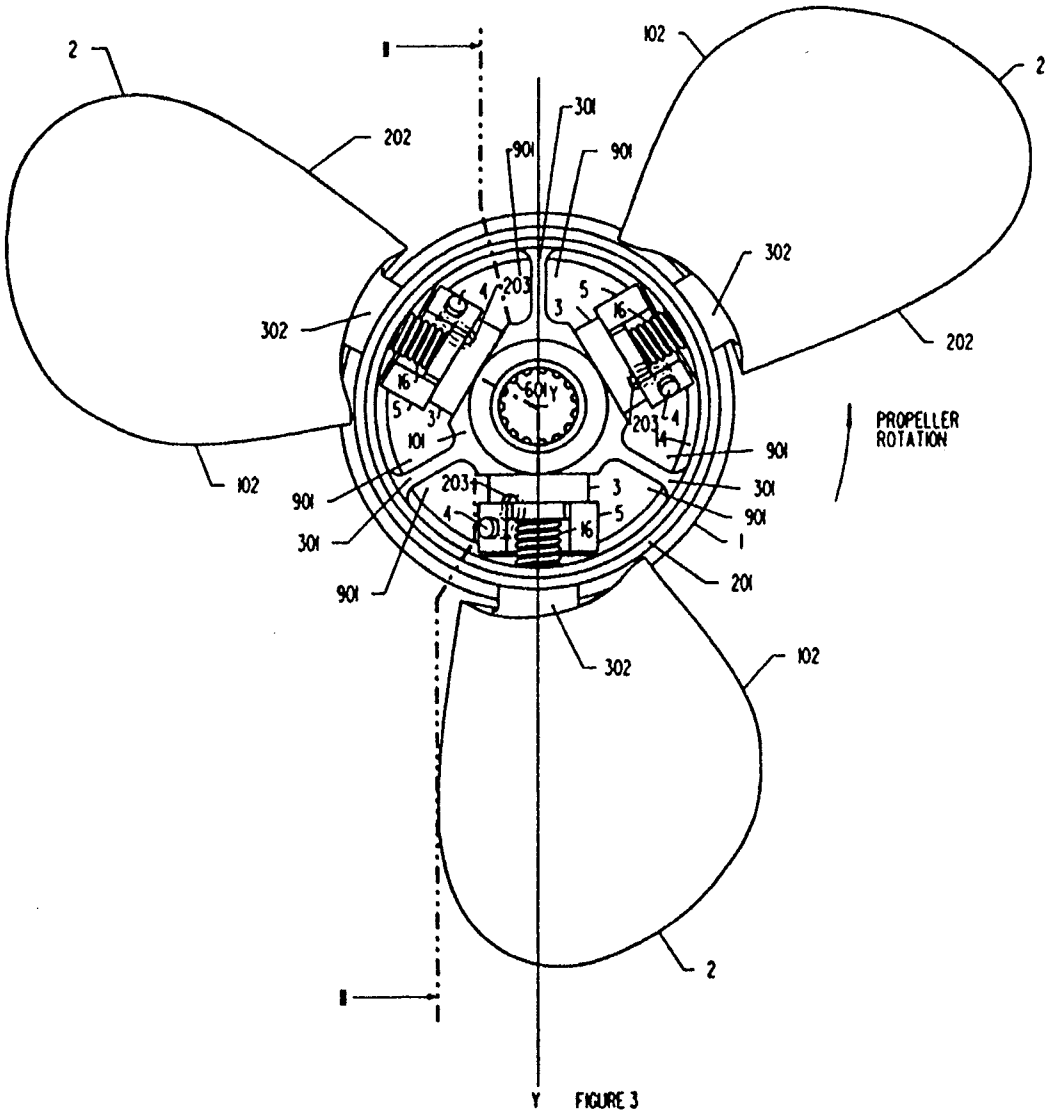
FIG. 3 is a partial front view of the propeller assembly of FIG. 2, of a single internal mechanism and blade, in the high pitch operational position.
Figure 4:
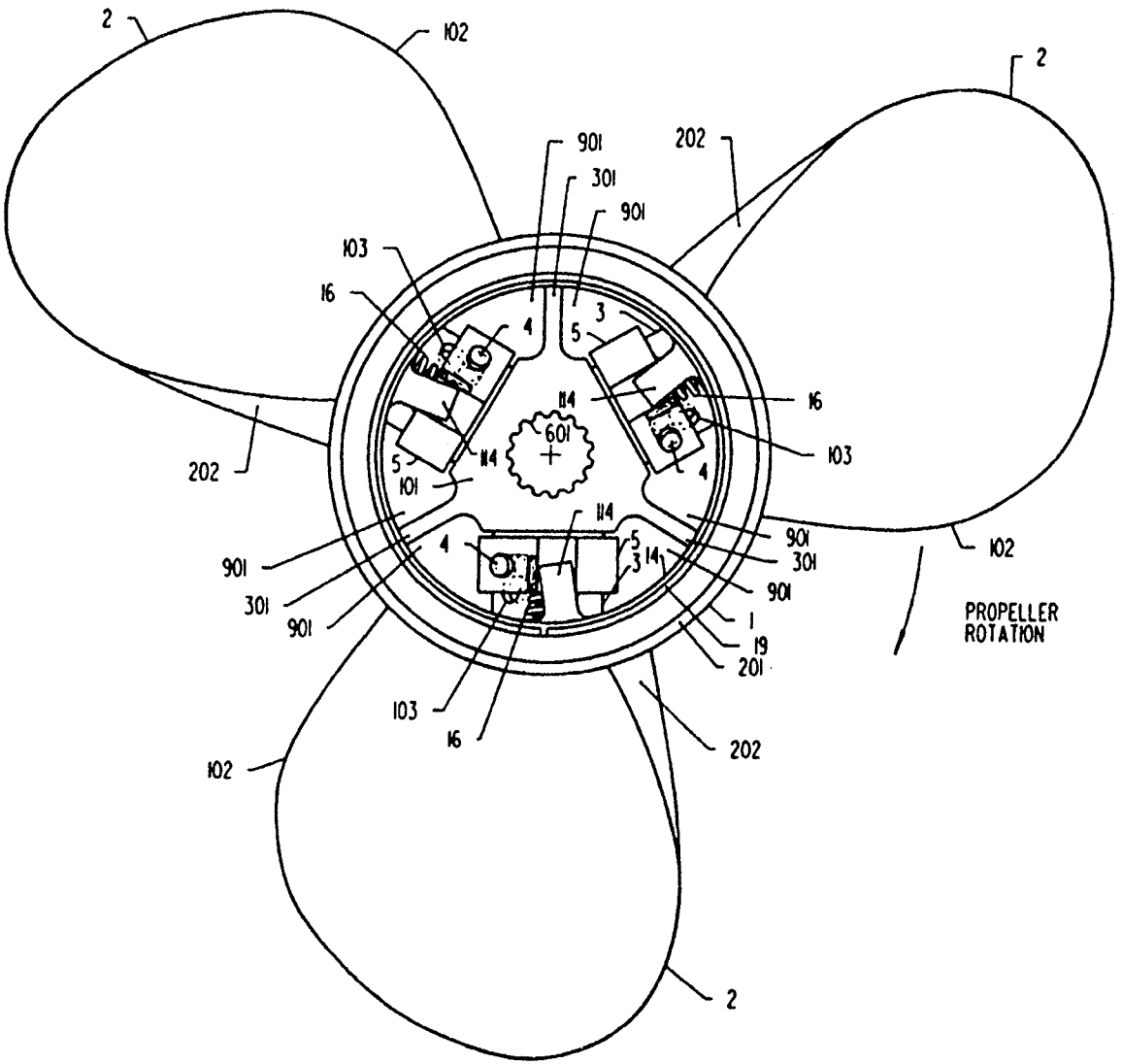
FIG. 4 is a rear view of the propeller assembly of FIG. 2 with the internal mechanism and blades in the low pitch operational position.
Figure 5:
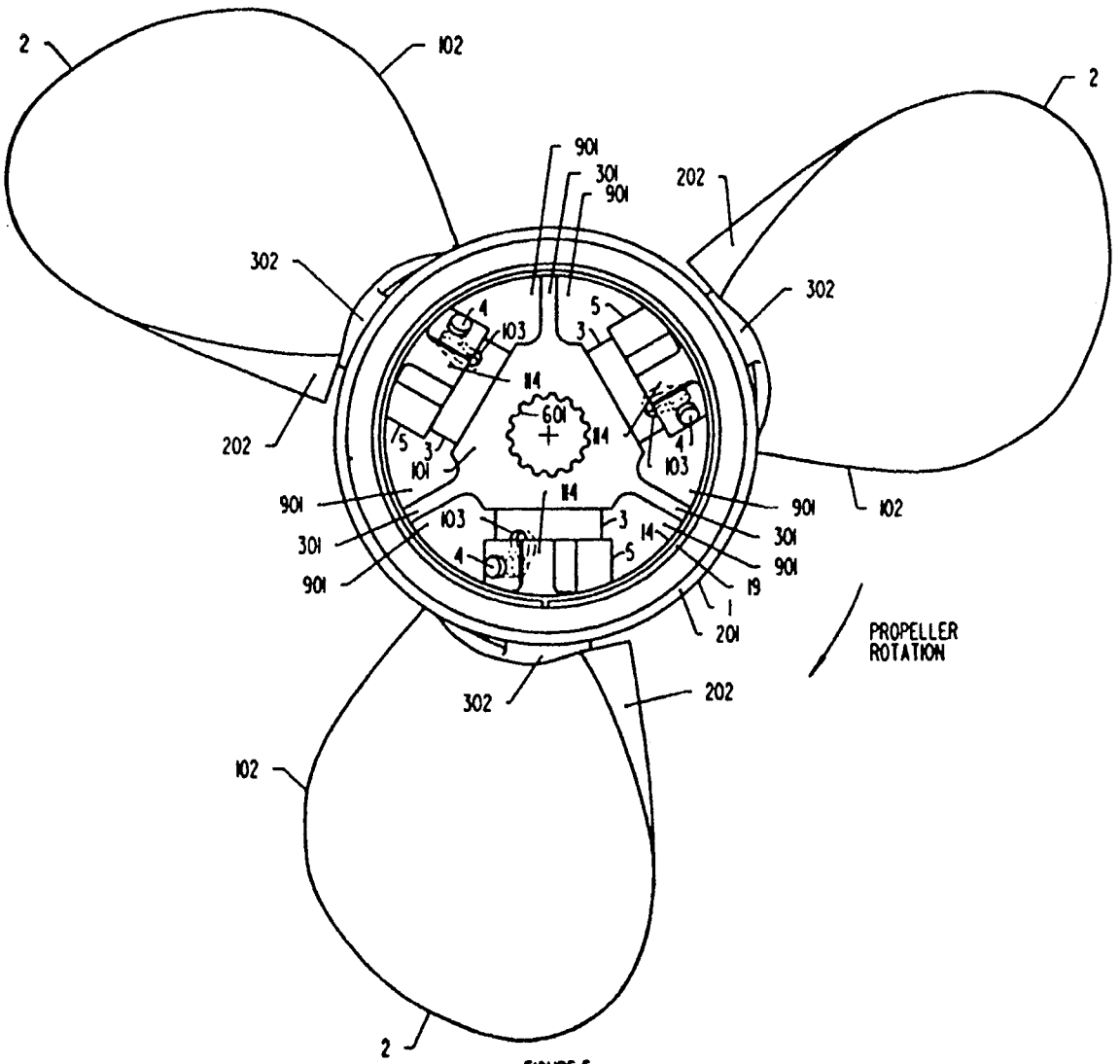
FIG. 5 is a partial rear view of the propeller assembly of FIG. 4, of a single internal mechanism and blade in the high pitch operational position.
Figure 6:
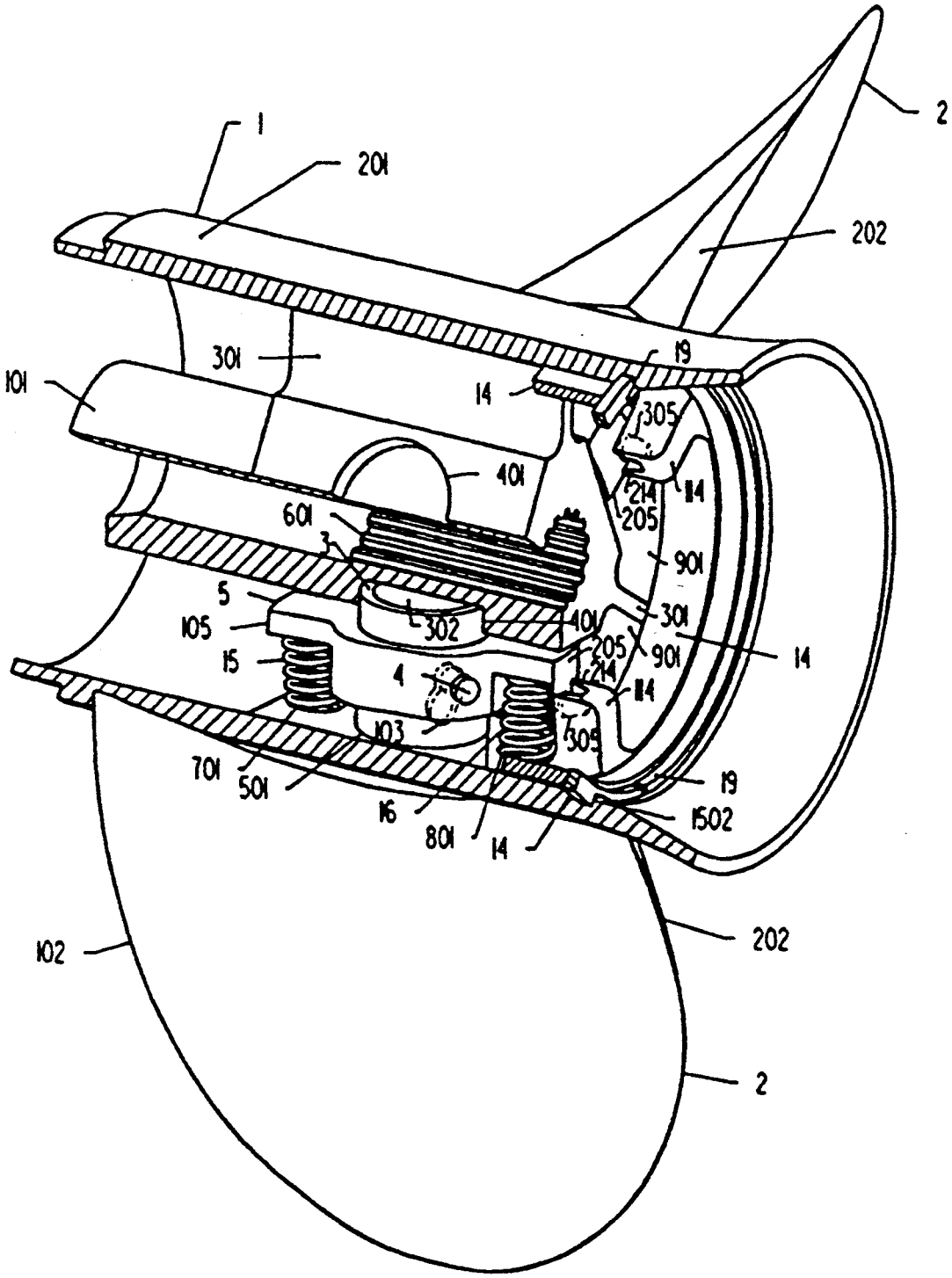
FIG. 6 is a sectional isometric view of the propeller assembly of FIG. 2 with the internal mechanism and blades in the low pitch operational position.
Figure 7:
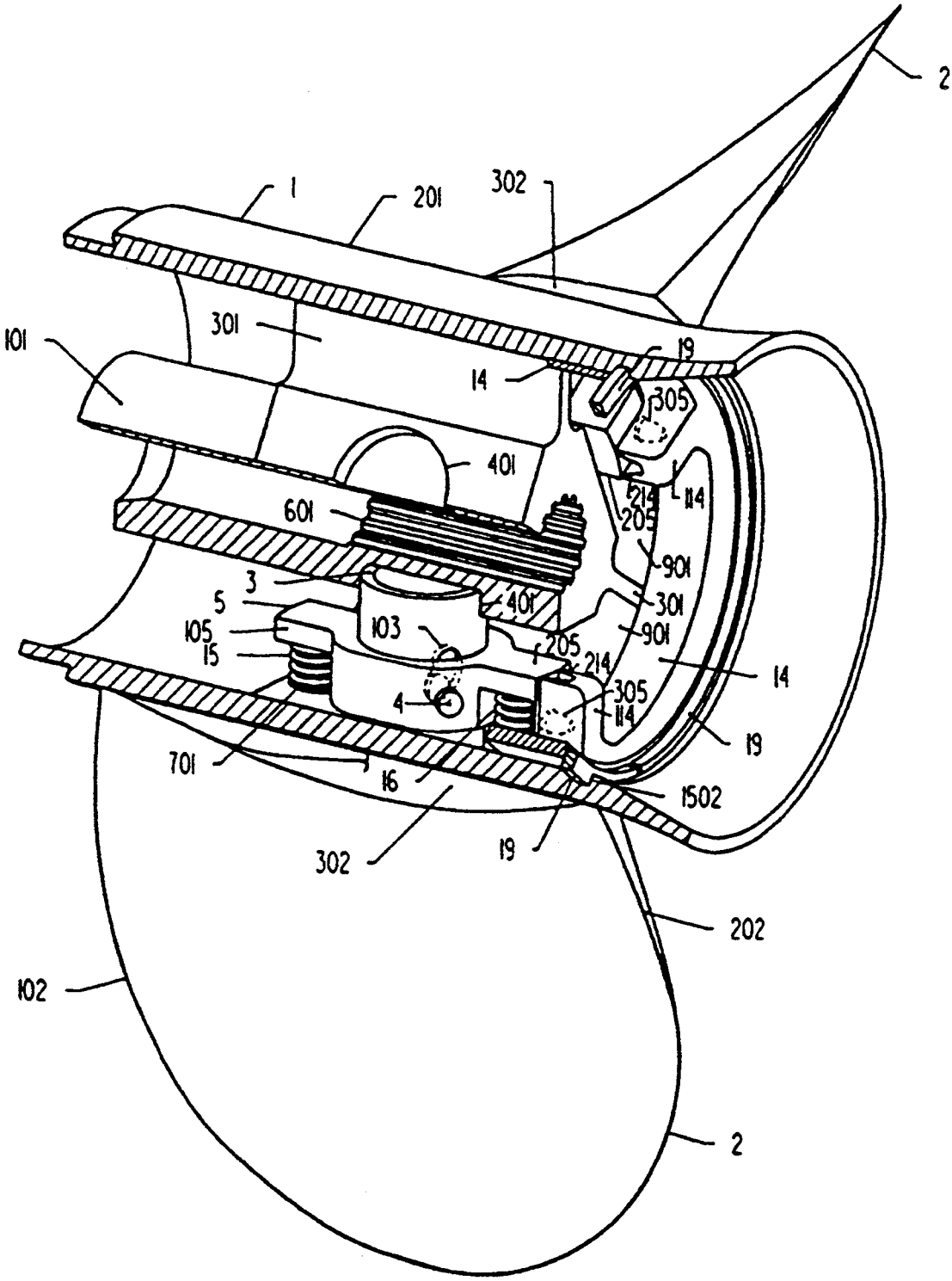
FIG. 7 is a partial sectional isometric view of the propeller system of FIG. 3 of an internal mechanism and blade in the high pitch operational position.
Figure 8:
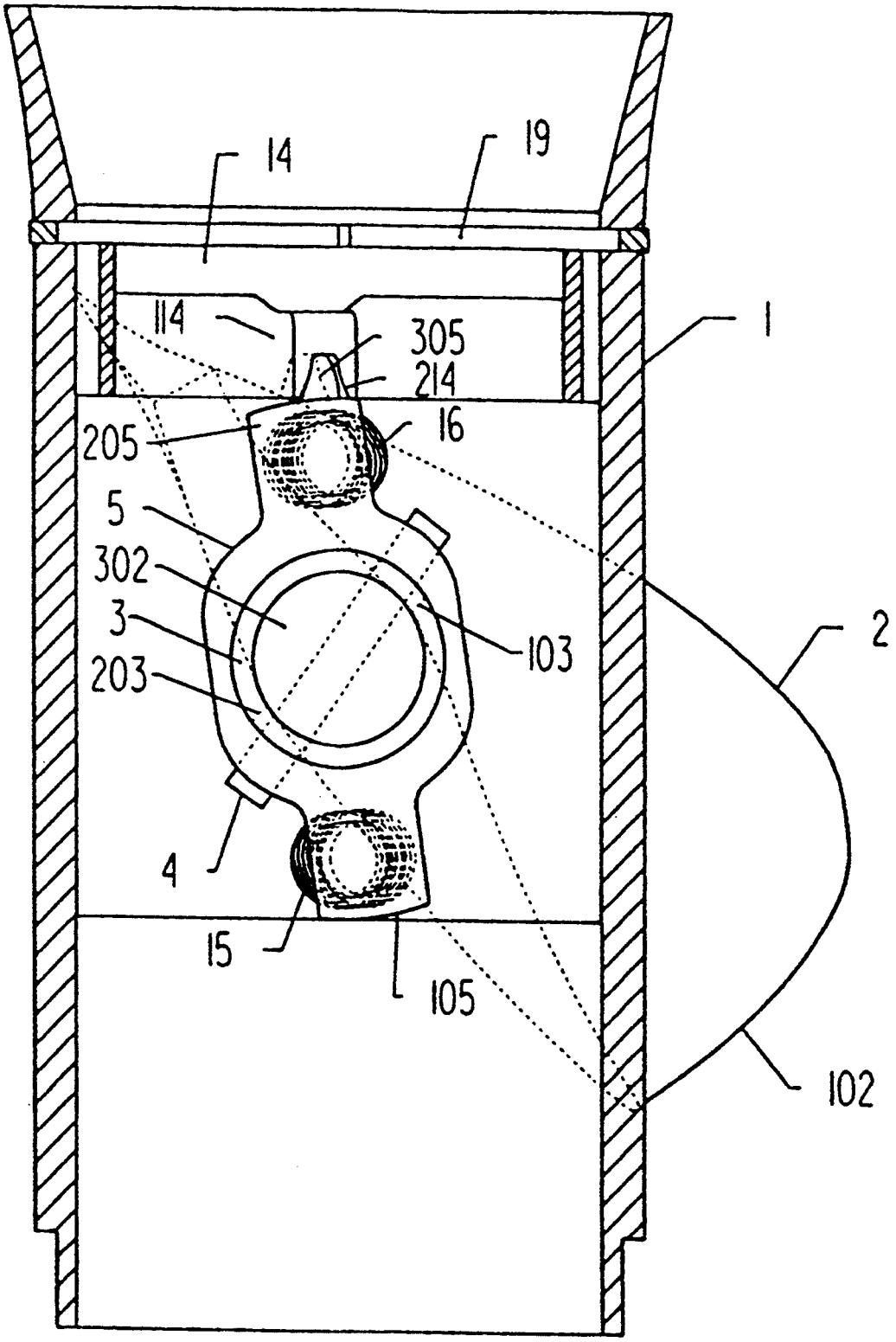
FIG. 8 is a random sectional view looking radially outward along a blade shaft showing the mechanism components for one blade, with the components in the low pitch operational position.
Figure 9:
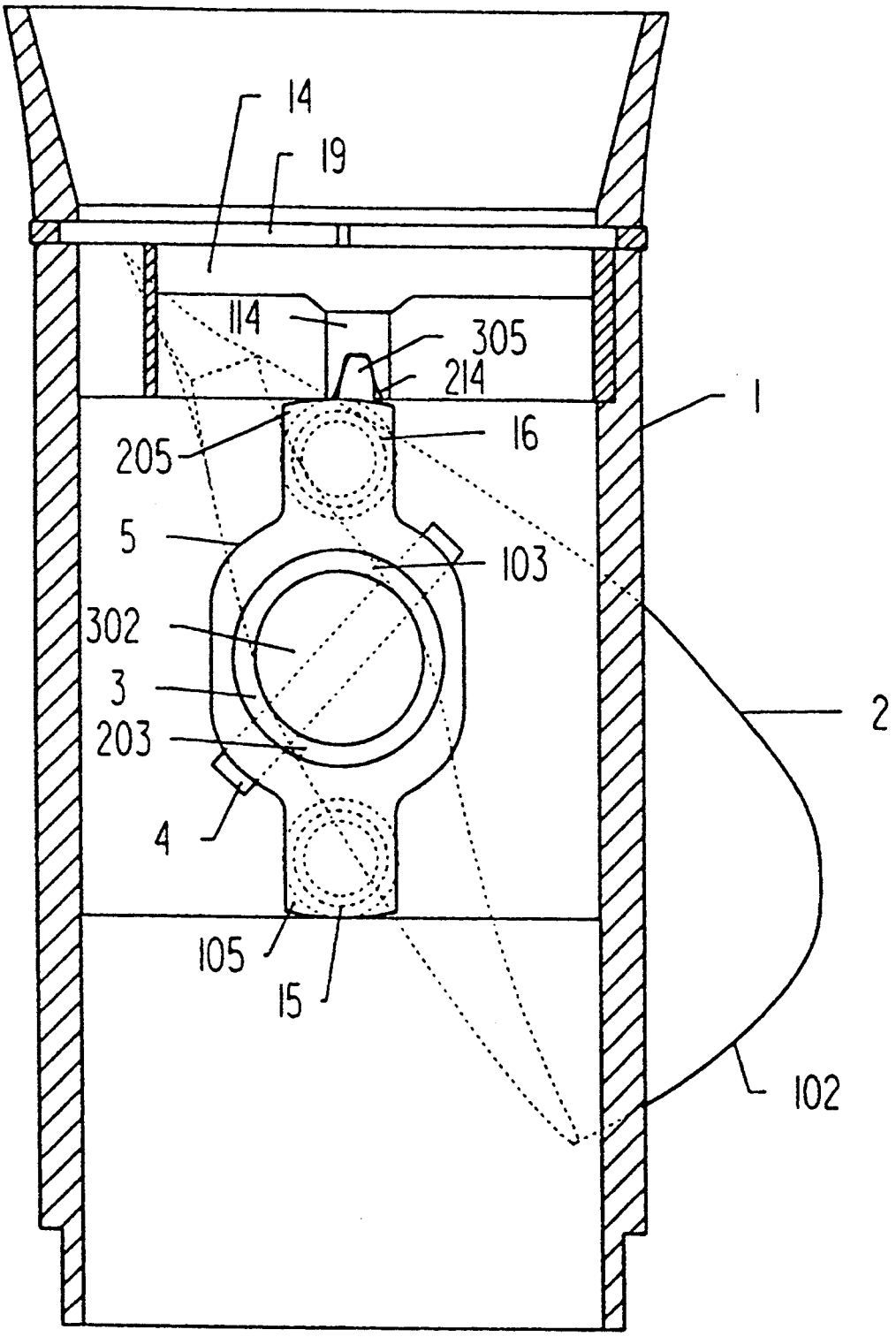
FIG. 9 is the same random sectional view as in FIG. 8, looking radially outward along a blade shaft showing the mechanism components for one blade, with the components in the high pitch operational position.
Figure 10:
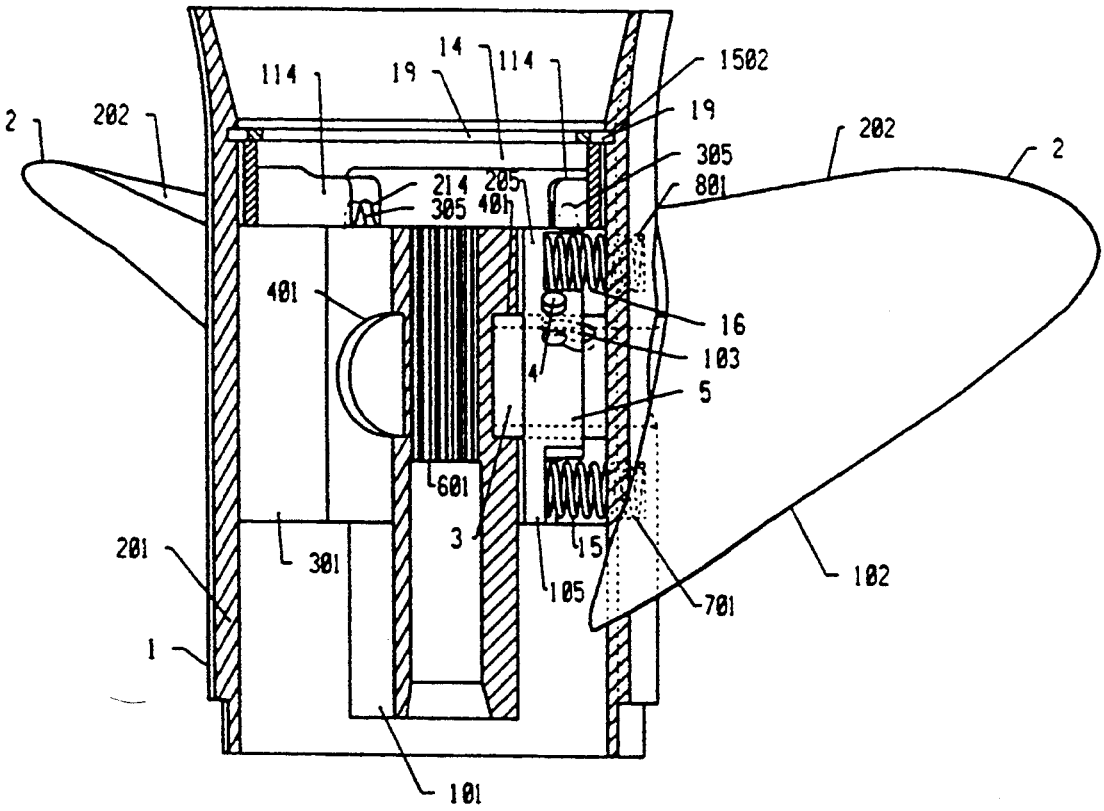
FIG. 10 is a longitudinal sectional view, taken along lines 10—10 of FIG. 2, showing the propeller components assembly of FIG. 2 in the low pitch operational position.

Referring to the drawings of the improved embodiments of the propeller of this invention, a substantially cylindrical hub case, generally indicated by the numeral 1, has three propeller blades generally indicated by the numeral 2, rotatably and axially slidably journalled to it. This propeller is designed to be detachably secured, without any further change, to an outboard engine or stern drive system in place of a conventional fixed pitch propeller. The present invention can also be adapted to an inboard engine drive shaft.

Concentrically located within and fixed to the hub case 1 is an inner hub, generally indicated by the numeral 101, and a rigid, spoked web, generally indicated by the numeral 301. Three bores 501 are formed through the circumferential surface 201 of the hub 1 and radially mating sockets 401 are formed in the inner hub 101. Cam sleeves 3 are inserted through the bores 501 into the interior of the hub and into the sockets 401; the sleeves 3 are fixed to the hub case 1 and to the inner hub 101. Each sleeve 3 is formed with opposed elongated cam slots 103 and 203, respectively, extending through the sleeve along the circumferential surface, as shown in FIGS. 24–30. The cam slots 103 and 203 are 180 degrees apart and are mirror images of each other; the long axis of each of the cam slots 103 and 203 extend along the circumferential surface of the sleeve 3 at an angle to the axis of the sleeve 3 (which is the blade shaft axis Y).

Contained within the inner hub 101 are splines 601 which mate with the propeller drive shaft. The hub also has passages 901 through which engine exhaust gasses may flow.

Each blade 2 is secured to, or integrally formed with, a blade shaft, or a retainer shank, 302 extending radially inwardly from the blade hydrodynamic surface, and being journalled through the outer hub case 1 and to the inner hub 101, within the sleeve 3. The blade shafts 302 each have a retainment hole 402 extending therethrough normal to the blade shaft axis Y. After a blade shaft 302 is inserted into each of the cam sleeves 3, the retainment hole 402 is aligned with the two cam slots 103,203, and a cam pin 4 is inserted through the cam slots 103 and 203 located in the cam sleeve 3 and through the blade retainment hole 402 therebetween. The cam grooves 103,203 are so situated on the sleeve surface 3, that when the cam pin 4 is abutted against the end of the cam slots 103,203 nearest the inner hub 101, the blade is in its lowest pitch position.

The geometrical relationship between the blade shaft 302, and the cam pin 4 and the slots 103,203, when the blade shafts 302 are positioned radially inward as in FIGS. 2, 4, 6, 8 and 10, requires that any radially outward movement of the blade shafts 302 causes the blade shafts 302, and thus the blades 2, to be simultaneously rotated to a high pitch position; the direction in which the surfaces of the cam grooves 103 and 203 extend, i.e., the angle relative to the blade shaft axis, by acting upon retainer pin 4, determines the relationship between the rotation of the blades 2, and the radially outward movement of the blades, generally towards a higher angle of pitch; this determines whether the blade movement is helical or non-helical.

Figure 31:
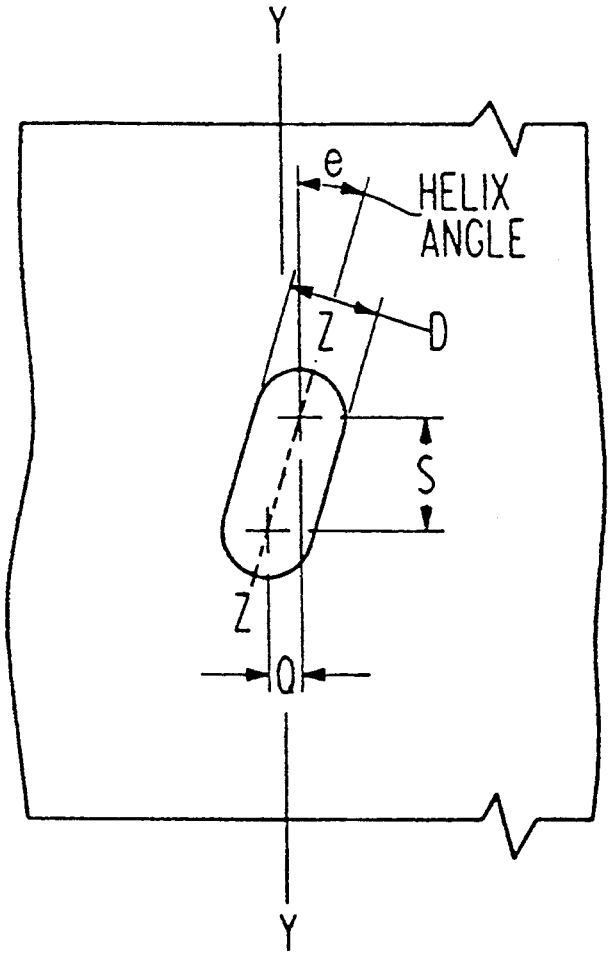
FIG. 31 is a developed view of a helical cam groove, i.e. one which does not include a pocket.

In prior art, such as presented in U.S. Pat. No. 2,998,080, by Moore, and U.S. Pat. No. 4,792,279, by Bergeron, and (in developed form in FIG. 31 herewith), the cam grooves impose substantially a helical relationship between the rotational and translational motions of the blade shafts 302 along their entire length. The center line of this slot is essentially a helical curve, or when viewed in developed form, as in FIG. 31, a straight line, Z. In this embodiment, any torque acting about the blade shaft axis Y, such as a hydrodynamic torque, tends to cause rotational and translational movement at any position along the slot. The angle e between the long axis of the slot Z and a line parallel to the shaft axis Y, determines the relationship between pitch change and linear movement of the blades. Generally, this angle is preferably at least about 5°, most preferably at least about 10°; the angle e is preferably not greater than about 50°, and most preferably not above about 30°.

Another concept presented in U.S. Pat. No. 2,682,926, to Evan, utilizes a linkage connection to the blade shaft which imposes a non-helical relationship between the blade rotational and translational radial motions, but this non-helical motion does not provide means to hold or restrain the blades in any discrete pitch angular position, by providing a resistance to any hydrodynamic torque applied about the blade shaft axis Y. It should be noted that prior art pitch stop provisions, for limiting the low to high pitch operational range do not provide the required restraining means in this context, since those stops do not generally oppose the hydrodynamic torque components, nor do they provide restraint for a reversal in the applied blade shank torque.

In the present invention, there is provided means to restrain rotational movement until there is sufficient centrifugal force effect to cause translational movement, and there is preferably also provided feedback force means acting in opposition to the release of the holding means with a force generally proportional to the hydrodynamic loading on the blades, to increase the centrifugal force effect needed to cause translational motion of the blades.

The physical principles and dynamic force relationships which must be considered in designing a self-actuating, pitch-changing mechanism for a particular propeller blade configuration, are explained in my copending parent applications, and that explanation is incorporated herein as follows:

The present invention utilizes the relationship between the hydrodynamic forces, lift ("L"), Drag ("D"), and Pitching Moment ("M"), and the inertial turning moments ($M_B$) acting upon the propeller blades, in a manner which was not previously recognized to be useful. The computations needed to define these forces have been generally well established by current engineering theories, but the interaction of all these factors had not previously been formulated in connection with the operation of an automatic, self-actuating variable pitch propeller. For the present invention, these computations are utilized to determine the dynamic load conditions acting on the propeller blades, with changes in boat velocity and acceleration and propeller (or engine) rotational speed (RPM), as the factors to be considered in the design of a self-actuating variable pitch propeller.

Referring to the drawings of the improved embodiments of the propeller of this invention, a hub case 13, 413 has three propeller blades 47, 447 rotatably journalled to it. This propeller is designed to be detachably secured, without any further change, to an outboard engine or stern drive system in place of a conventional fixed pitch propeller. The present invention can also be adapted to an inboard engine drive shaft.

Concentrically located within and fixed to the hub case 13, 413 is an inner hub and rigid web, generally indicated by the numerals 113,513 and 201, respectively. Each blade 47, 447 is secured to a retainer shaft 40, or integrally formed with a blade shank 440, extending radially and being Journalled through the outer hub case 13, 413 and to the inner hub 113, 513, and supported by two cylindrical bearing supports (44 and 45 or 444 and 445) on the outer case 13, 413 and inner hub 113, 513, respectively.

In designing a self-actuating, pitch-changing mechanism for a particular propeller blade configuration, certain physical principals of dynamic force relationships must be considered. The means for determining these dynamic forces are individually well known to the art and their computation is readily accomplished by following currently available engineering computation methods. However, the interrelationship of these forces has not previously been utilized in this context. Considering first the hydrodynamic forces acting upon the propeller blade surfaces, the marine propeller blade is a lifting body, or hydrofoil, acting similarly to an aircraft wing. The combined hydrodynamic forces created by the rotation of the propeller generates a thrust to propel the boat. The resultant hydrodynamic force acting on each blade changes significantly, both in magnitude and in location on the blade, depending upon the relative water velocity and angle of attack ("$\alpha$"), which are in turn related to the boat's forward velocity and propeller rotational speed.

In conventional aerodynamic theory (*Theory of Flight,* by Richard Von Mises, Dover Publications, 1959, and *Foundation of Aerodynamics,* by A. M. Kuethe & J. D. Schetyer. John Wiley & Sons, 1959), the algebraic summation of the pressures acting over the entire airfoil, or blade surface, can be represented as a single, resultant hydrodynamic force, having its point of application defined as the "center of pressure" ("c.p."). Conventionally, the "aerodynamic center" ("a.c."), of a blade, or airfoil, is defined as a point where the airfoil section pitching moment coefficient does not change but remains constant regardless of changes in the fluid angle of attack of the blade. For conventional airfoil sections, the aerodynamic center is generally between the 23 and 27 percent chord position and is commonly estimated to be at the 25 percent chord position. Furthermore, for most conventional airfoil sections (e.g. NACA Series 16), the pitching moment coefficient is negative, i.e., tends to bias the airfoil toward a lower angle of attack (pitch). For this automatic, self-actuating variable pitch position marine propeller, the vector magnitude and direction of the resultant hydrodynamic force and the location of the center of pressure relative to the blade pivot axis are among the major parameters in determining the timing of the pitch change. For propeller applications on high performance boats, it is generally desirable to use blades wherein the airfoils are modified at the trailing edge by forming a downward (or outward) edge curl, see FIG. 27. This trailing edge airfoil modification is commonly referred to as "cupping". This "cup" helps to prevent flow separation, or propeller "blow out" when operating in a cavitating or ventilating situation.

A design consequence of utilizing "cupped" propeller blades in the variable pitch propeller described herein is that the cupping of the trailing edge effectively moves the airfoil center of pressure further towards the trailing edge.

Figure 11:
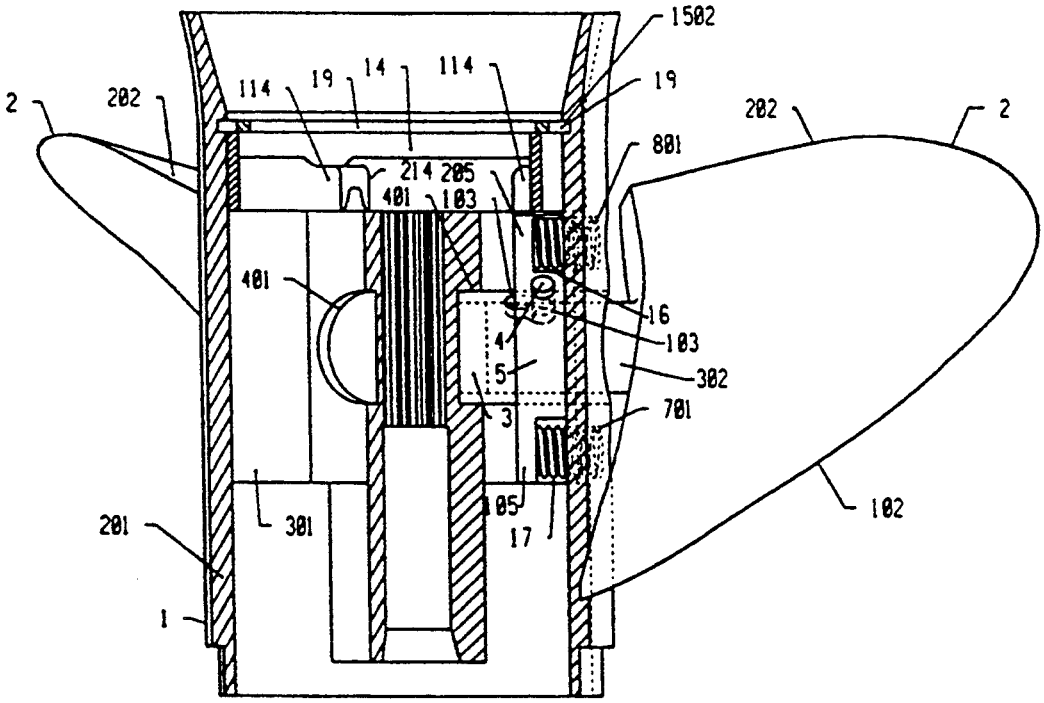
FIG. 11 is a partial longitudinal sectional view, taken along lines 11—11 of FIG. 3, showing a portion of the propeller components assembly of FIG. 3 in the high pitch operational position.
Figure 12:
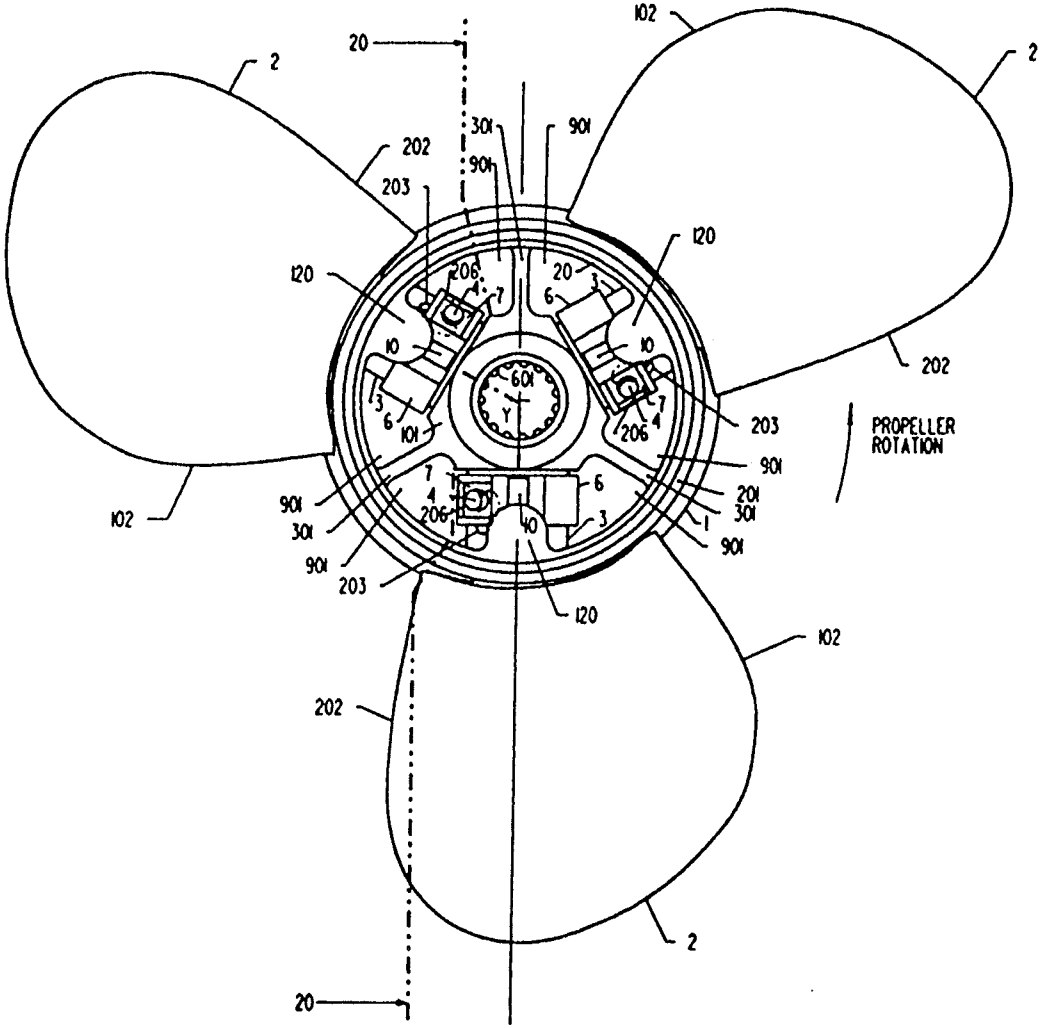
FIG. 12 is a front view of a second embodiment of the propeller assembly having a rotating coordinating ring with the internal mechanism and blades in the low pitch operational position.
Figure 13:
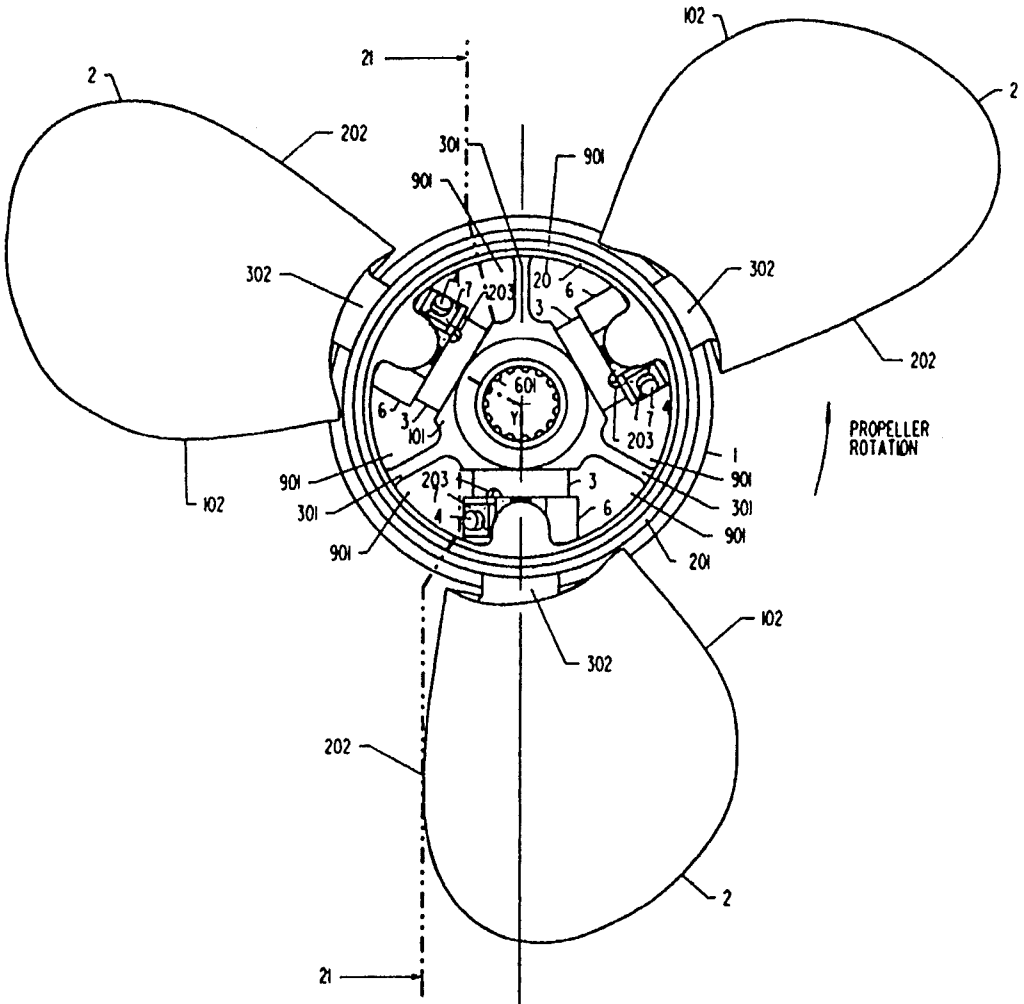
FIG. 13 is a partial front view of the propeller assembly of FIG. 12, of a single internal mechanism and blade, in the high pitch operational position.
Figure 14:
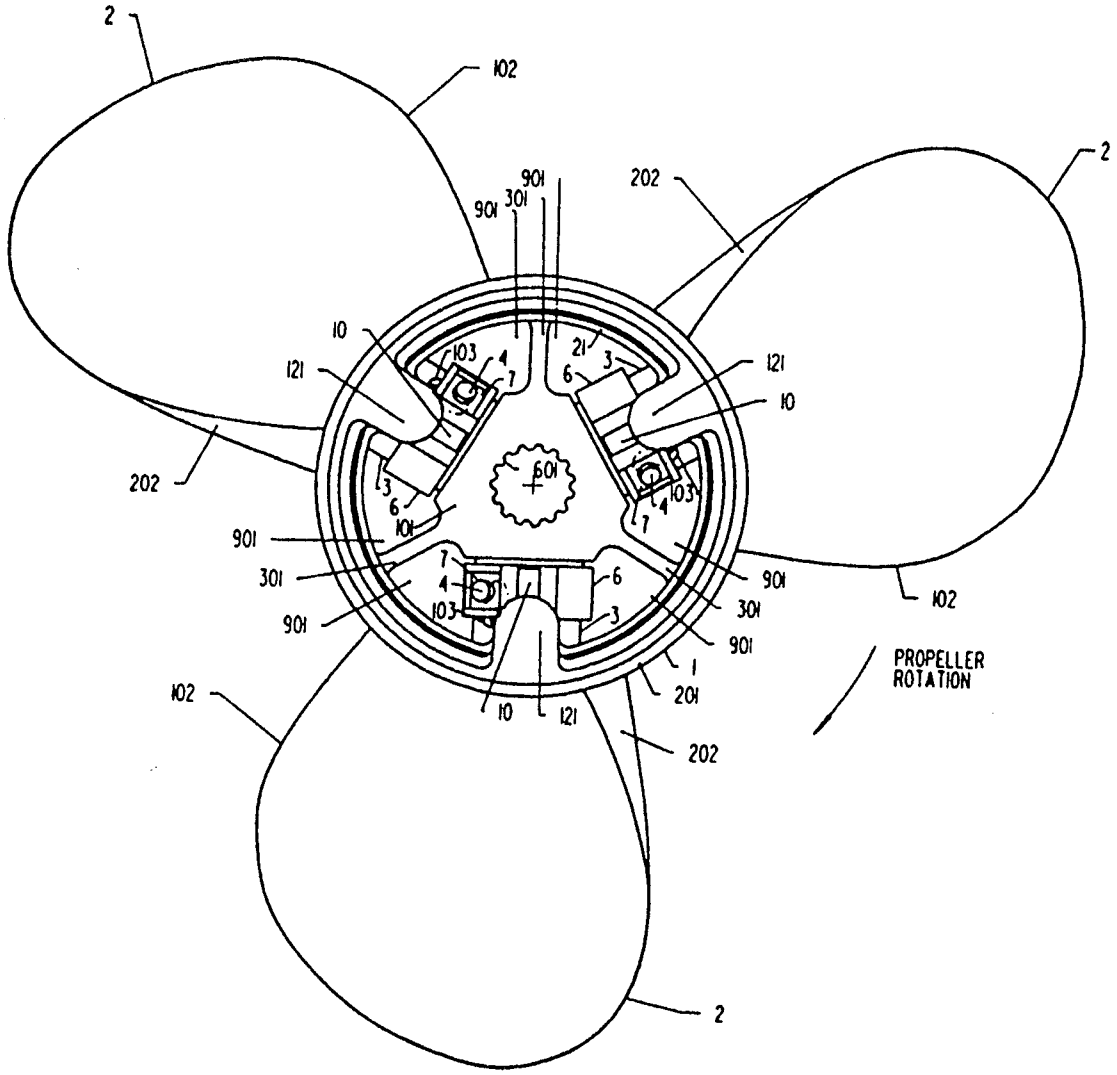
FIG. 14 is a rear view of the propeller assembly of FIG. 12 with the internal mechanism and blades in the low pitch operational position.
Figure 15:
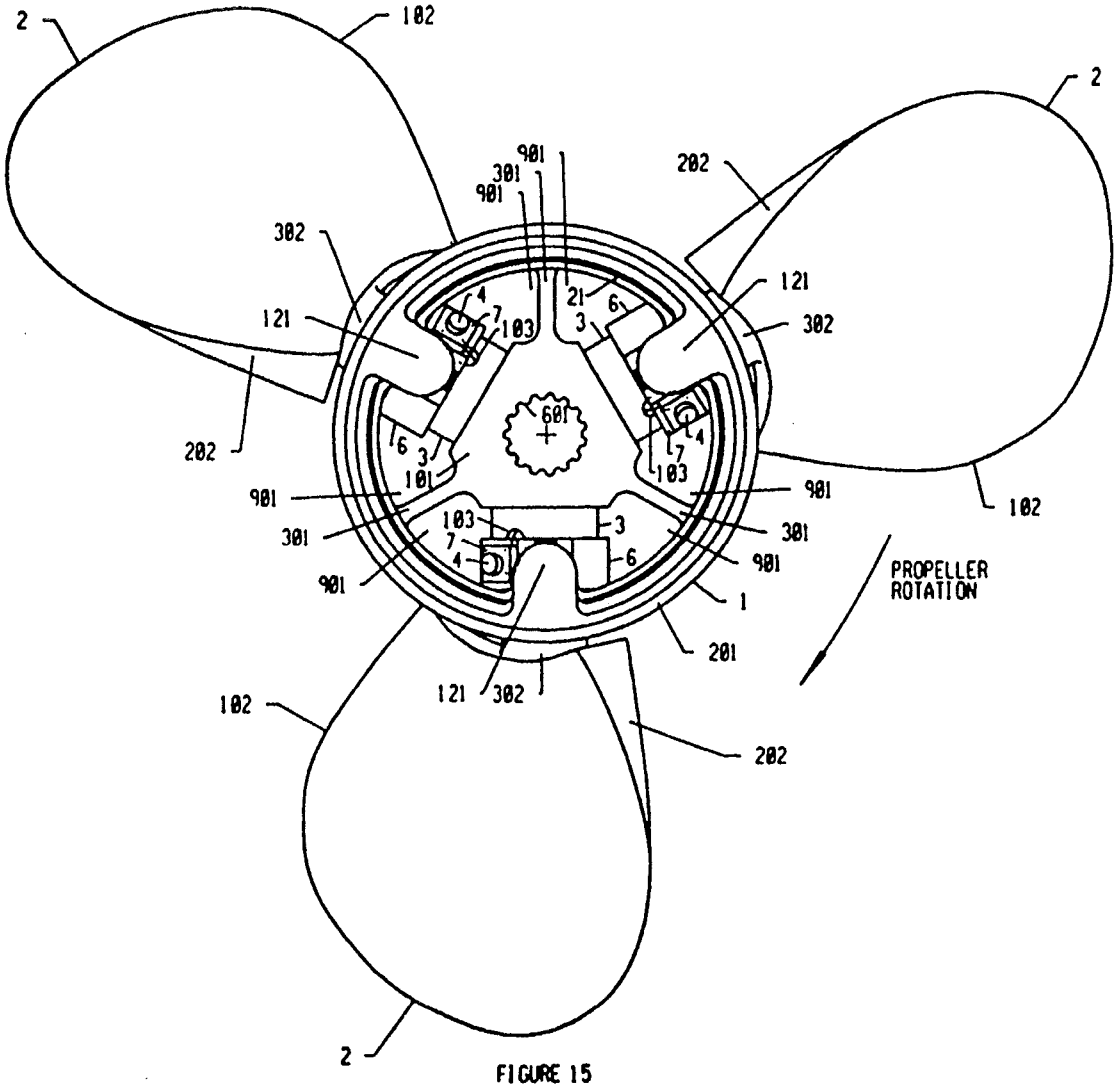
FIG. 15 is a partial rear view of the propeller assembly of FIG. 13 of a single internal mechanism and blade in the high pitch operational position.
Figure 16:
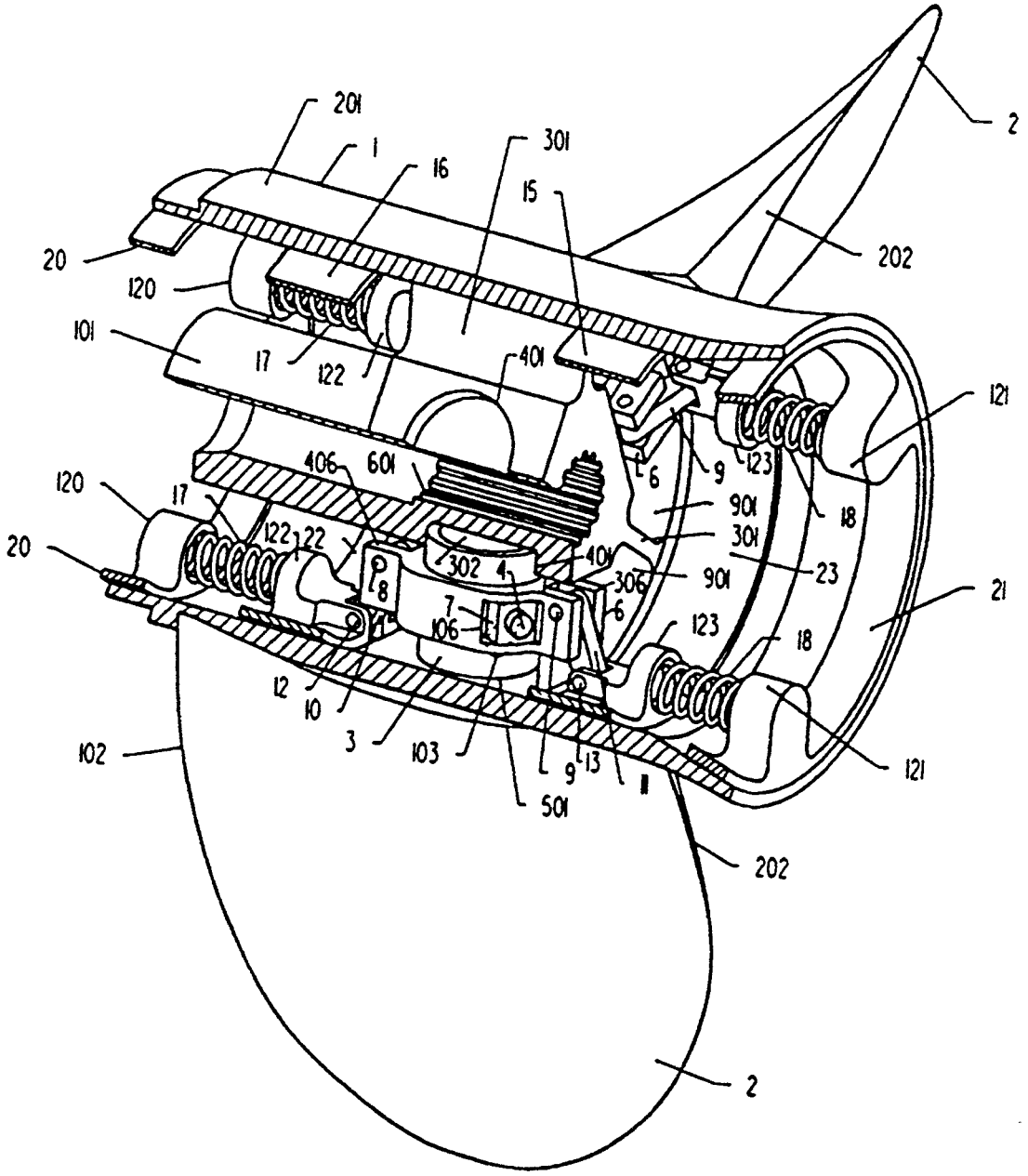
FIG. 16 is a sectional isometric view of the propeller assembly of FIG. 12 with the internal mechanism and blades in the low pitch operational position.
Figure 17:
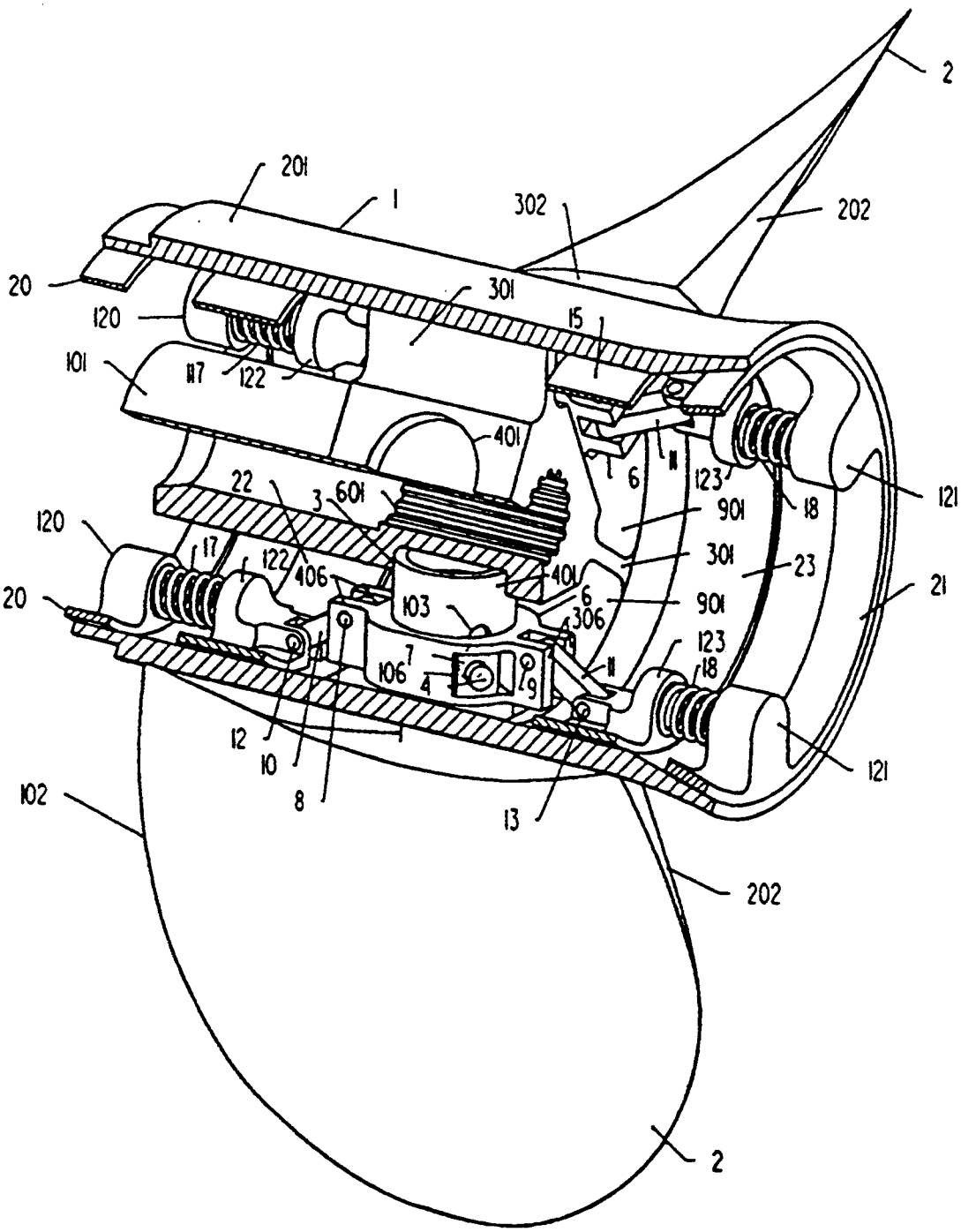
FIG. 17 is a sectional isometric view of the propeller assembly of FIG. 13 with the internal mechanism and blades in the high pitch operational position.
Figure 18:
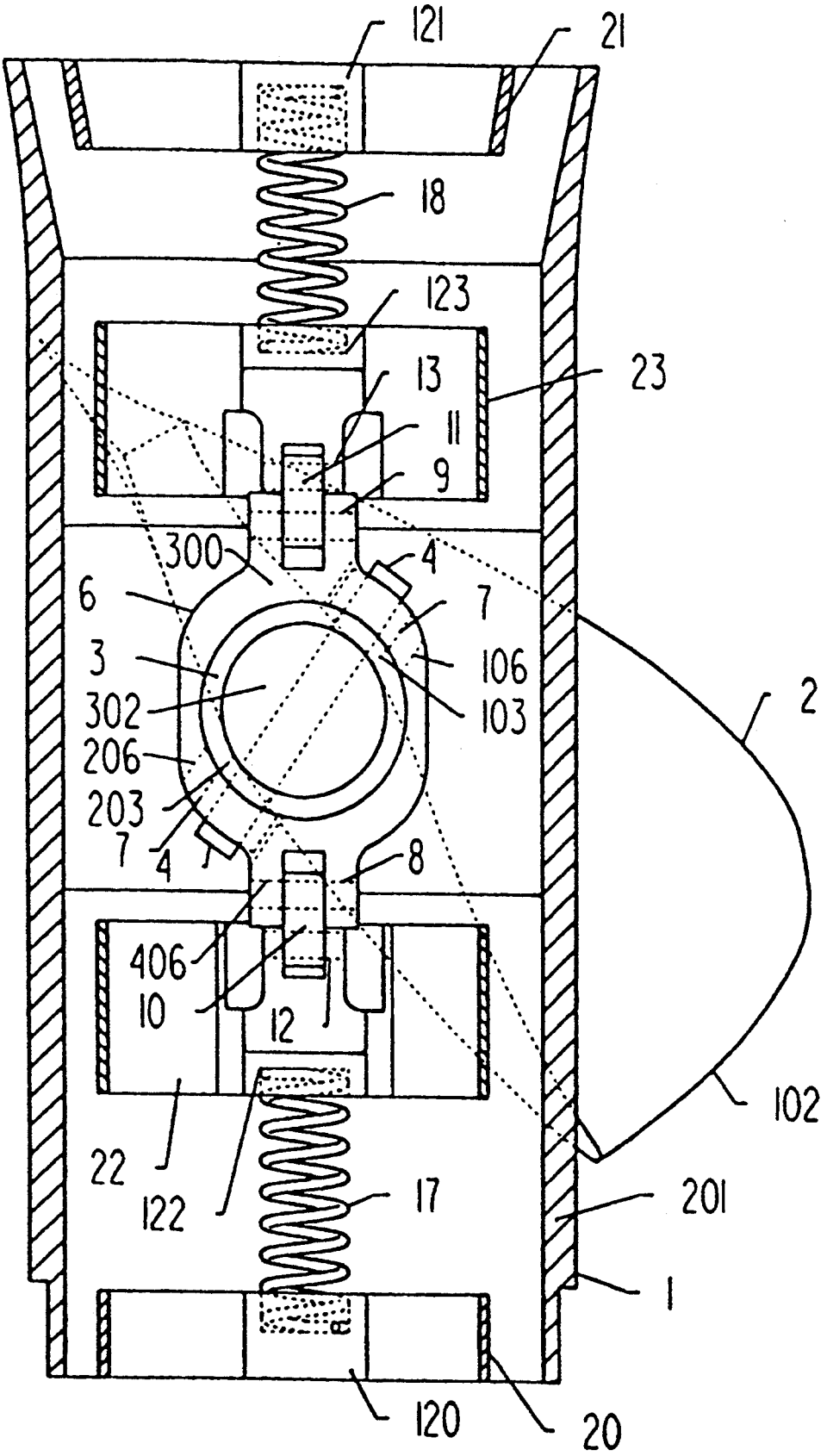
FIG. 18 is a random sectional view of the propeller assembly of FIG. 12 looking radially outward showing the mechanism components for one blade, with the components in the low pitch operational position.
Figure 19:
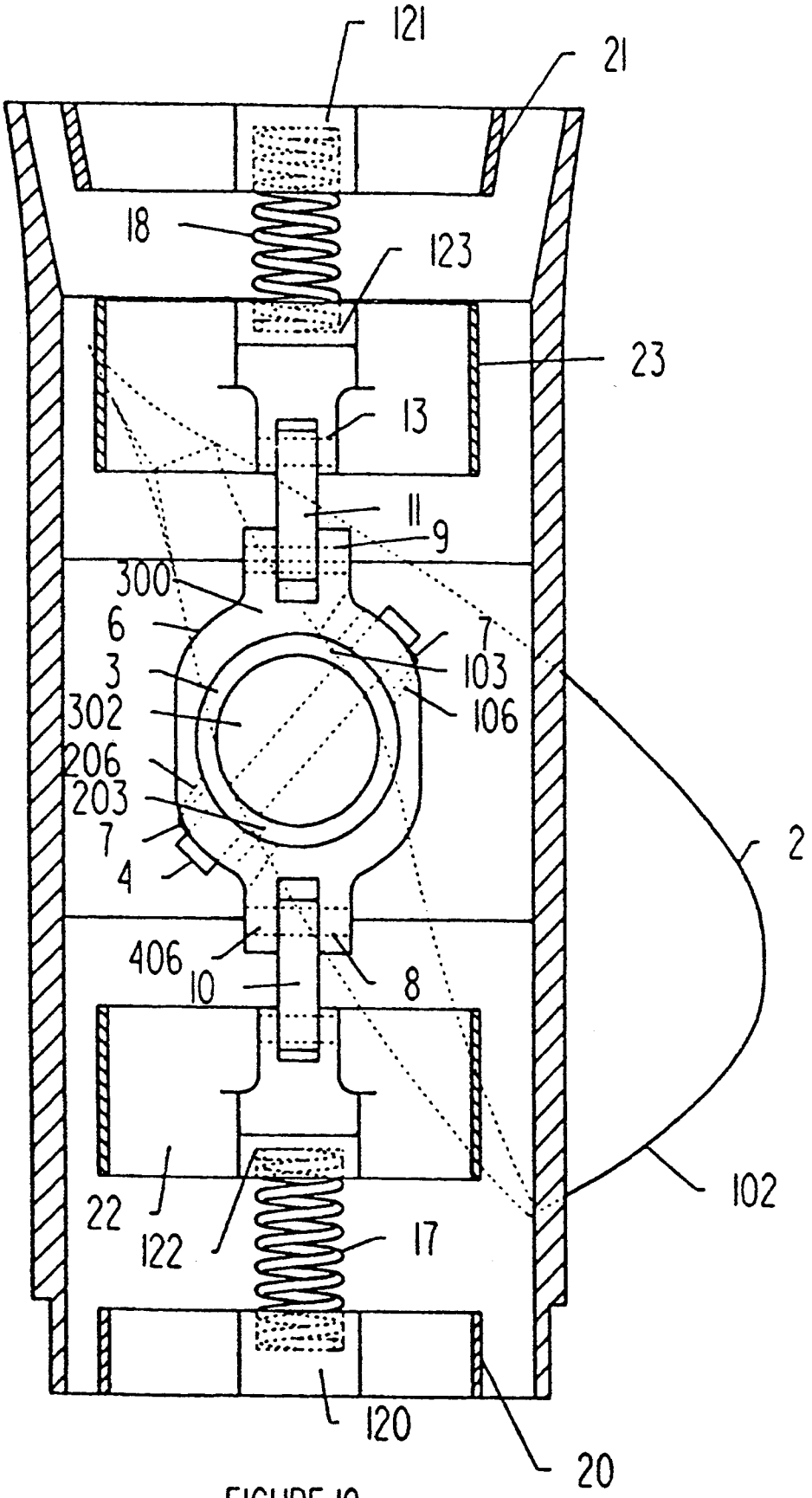
FIG. 19 is the same random sectional view as in FIG. 18, looking radially outward showing the mechanism components for one blade, with the components in the high pitch operational position.
Figure 20:
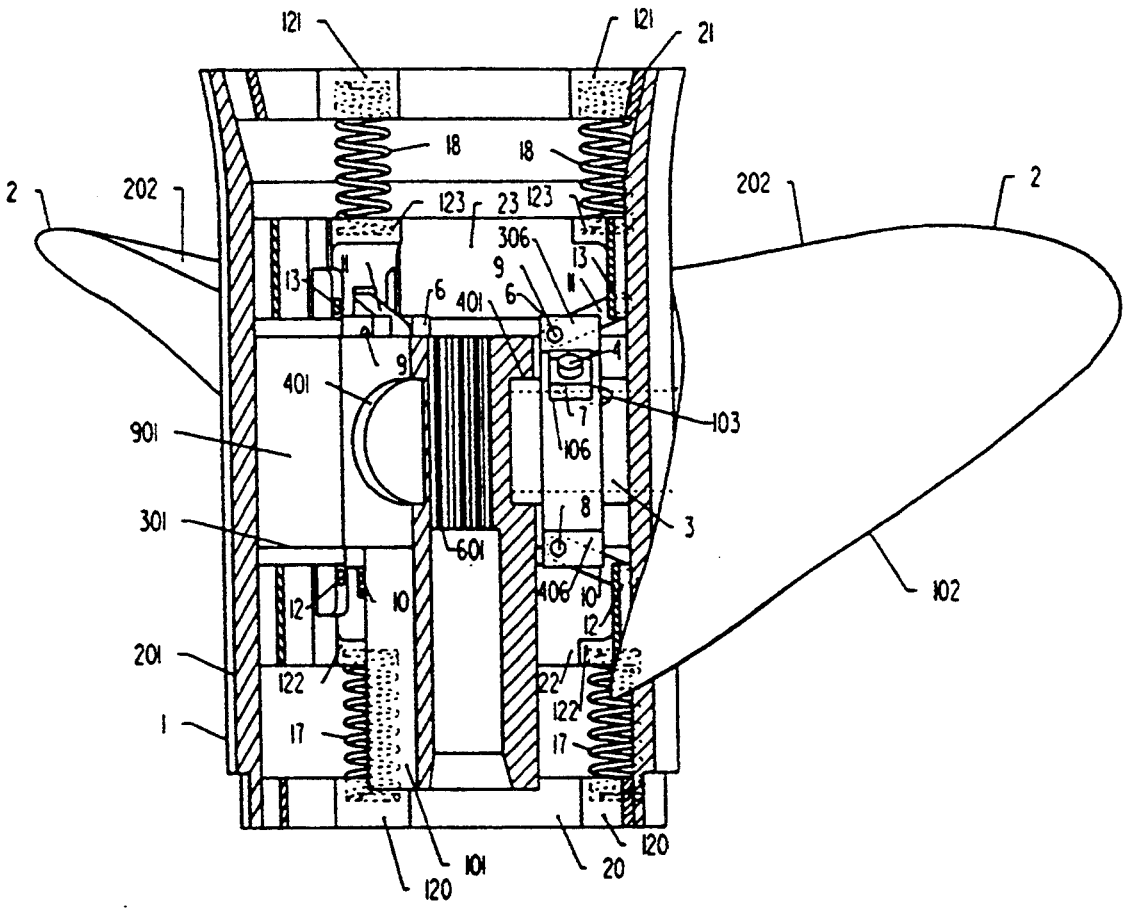
FIG. 20 is a longitudinal sectional view, taken along lines 20—20 of FIG. 12 showing the propeller components assembly in the high pitch operational position.
Figure 21:
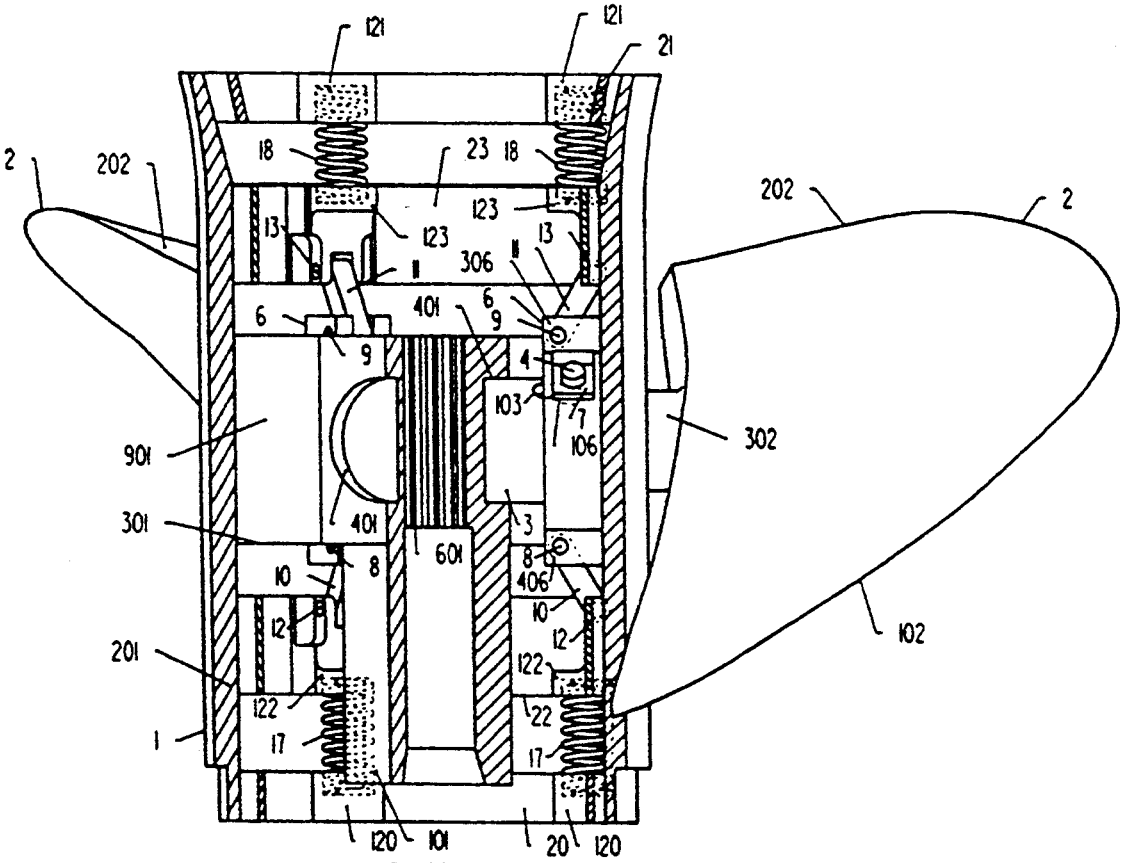
FIG. 21 is a longitudinal sectional view, taken along lines 21—21 of FIG. 13, showing the propeller components assembly in the high pitch operational position.

Referring to FIG. 12, which describes the instantaneous forces acting upon a propeller blade as the boat is initially accelerated from a relatively low boat velocity ($V_B$), the resultant hydrodynamic force ("R") acting upon the propeller blade 43, 447 is a function of the lift force ("L"), the drag force ("D") and pitching moment ("M"). The center of pressure for such low boat velocity with high propeller rotational velocity is located relatively close to the blade's leading edge 147, e.g., at approximately the 20% mean aerodynamic chord ("MAC"). As the boat's velocity ($V_B'$) through the water increases, however, the drag force increases (to D'), the pitching moment increases to (M'), and the lift force decreases (to L'), such that the resultant hydrodynamic force (R') is reduced. Equally significant, the center of pressure moves aft (to C.P.') towards the trailing edge 247 of the blade, e.g., the center of pressure can move to about the 60% MAC location, under high velocity, low angle of attack conditions. (see FIG. 11) Generally when the boat linear speed and propeller rotational speed are at their respective maximum operating levels, the center of pressure will lie between the 35% to 55% MAC range for conventional NACA linear 16 airfoils, and between the 45% to 60% MAC range for the cupped airfoils. Thus, whereas the preferred blade pivot center for "non-cup" blades was previously described to be between the 35% to 55% mean aerodynamic chord, the optimum blade pivot center for "cupped" blades is between the 45% to 60% mean aerodynamic chord.

The resultant hydrodynamic force ("R") acting on each propeller blade 47 is the direct geometric sum of the torque force (Q) and thrust force (T) components, i.e., $$R = \sqrt{T^2 + Q^2}\,, \qquad 1.$$

Very rough approximations of the torque force (Q) and the thrust force component (T) at a constant speed, can be obtained by the following formulae:

$$T = n375h/vN, \qquad 2.$$

wherein h is engine horsepower, n is propeller efficiency, V is the boat velocity (mph) and N is the number of blades on the propeller; and $$Q = t/rN, \qquad 3.$$

wherein t (torque)=63000h/s; r is the radial distance from the propeller shaft centerline to the blade center of pressure, and s is the rotational speed of the propeller (RPM).

The above formulae can be rendered somewhat more precise by following the methods set forth in current engineering literature, for example, in T. P. O'Brian, "*THE DESIGN OF MARINE SCREW PROPELLERS*", (Hatchinson Scientific and Technical, 1969).

The resultant hydrodynamic turning moment ("$M_h$") acting on each blade at the pitch change condition can be calculated as follows: $M_h = Rg$, wherein R is the absolute value of the hydrodynamic vector, R, as calculated above by Equation 1, multiplied by the perpendicular distance (g) between the vector R and the blade pivot center. The value of "g" is in turn determined by the location of the center of pressure (c.p'), and the direction of the vector R' at the conditions of pitch change. The location of c.p. can be determined for each blade design and operating parameters, in accordance with well-known aerodynamic or hydrodynamic methodology, as explained more fully in the above-cited texts.

Another force independently acting to change the pitch position of the blade is the propeller blade rotational, or inertial, force moment ($M_B$). In determining the magnitude of this inertial force, the blade can be approximated as a thin curved plate having its mass distributed within a plane intersecting the blade pivot center line, as shown in FIG. 12, for calculating out the moment "M", from the following equation:

$$M_B = W/g\ (tw^2 \cos B \sin B)^2 \int_{x=o}^{x=b/2} \int_{R-R_1}^{R-R_o} x^2 dx dR \qquad 4.$$

This inertial force tends to move the blade in a direction to reduce its pitch, and is proportional to the square of the rotational speed of the blade. Procedures for calculating inertial turning moments of propellers are described in current engineering literature, for example, in H. Mabine and F. Ocvik, "*MECHANISMS AND DYNAMICS OF MACHINER*" (John Riley and Sons, Inc. 1963).

According to the invention described herein, the surfaces of the cam slots 103 and 203 impose a relationship between the rotational and translational motions of the blade shaft 302 that deviates substantially from that of a helical path, and in a manner that holds or restrains the blades in one or more discrete angular pitch positions. This can be generally accomplished by providing a cam surface at the desired discrete pitch angle position of the blade, wherein the blade is directed to move translationally radially outwardly without permitting rotational motion; thus a force, such as the hydrodynamic force, tending to rotate the blade, will have no effect on the blade, until the centrifugal force is sufficient to move the blade beyond that position on the cam surface.

Figure 27:
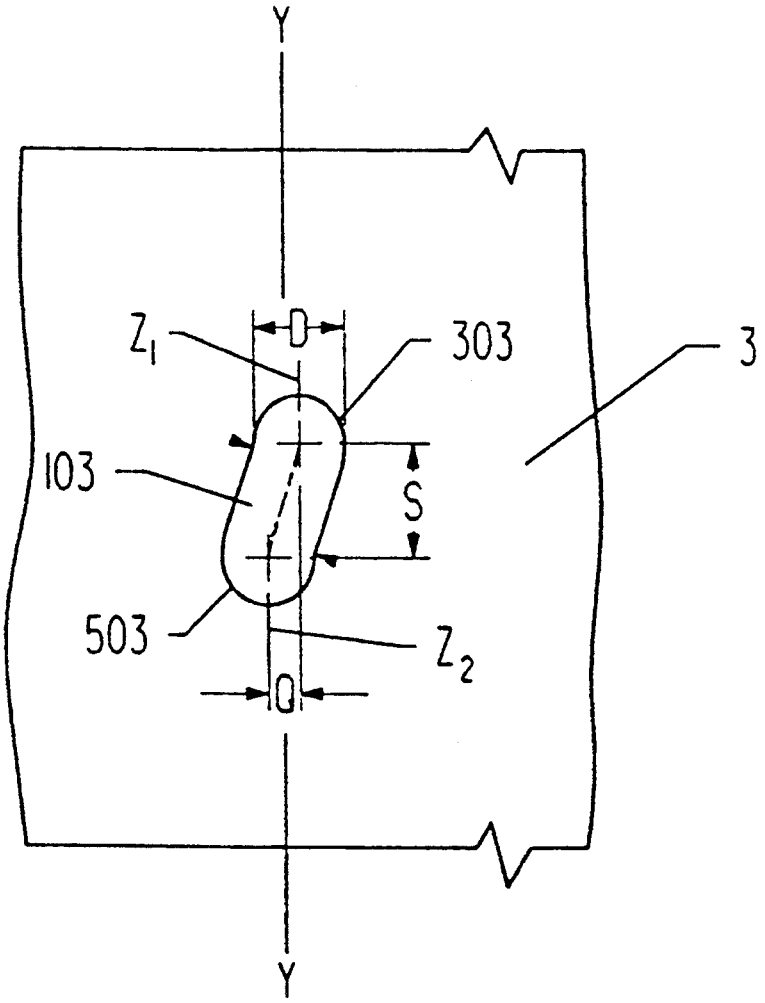
FIG. 27 is a developed view showing an alternate configuration for the sleeve cam groove geometry showing the blade shaft aligned pocket for both the radially inward, low pitch operational position and the radially outward, high pitch position.

In one preferred embodiment, shown in FIG. 27, the cam slot 103 (and its mirror image 203) have a pocket 303 located at the radially inward end of the groove, whereby the blade shaft 302 is prevented from rotating when moving radially outward, until the blade is translated to a position outside of the pocket; once the pin 4 is outside of the pocket 303, the pin 4, following the cam slot surface, causes the blades to rotate toward a higher angle of pitch, generally helically, as the blade is translated radially outwardly by the centrifugal force effect. The central portion of the cam slot has a center line oriented as in FIG. 31. The cam slot design presents a cam surface which resists the hydrodynamic forces tending to rotate the blades 2 about the blade shafts 302, when the pin 4 is inserted into the cam groove pocket 303. Hence, the blades are effectively held in a discrete lower pitch position until the radially outward forces acting on the blade 2 are sufficient to cause the required outward radial displacement of the blade 2, moving the pin 4 out of the pocket 303.

In the slot design depicted in FIG. 27, a similar second pocket 503 is provided in the radially outward end of the cam groove 103. With the blade pin 4 positioned in the outward pockets 503, the blade is held in the discrete higher pitch position until radial inward forces acting on the blade 2 are sufficient to cause the required radial inward displacement of the blade 2 moving the pin out of the high pitch pocket 503. The center line $Z_1$, $Z_2$ of the pockets 303,503 are thus substantially parallel to the blade axis Y.

Figure 32B:
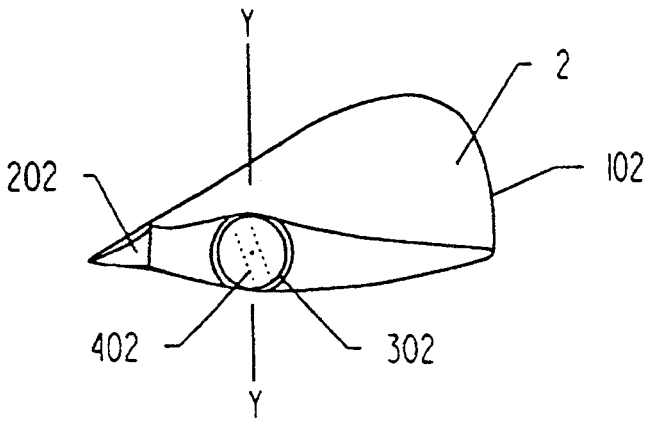
FIG. 32*b* is a top view of the propeller blade in FIG. 32*a*, looking radially outward along the blade shaft axis Y.
Figure 32A:
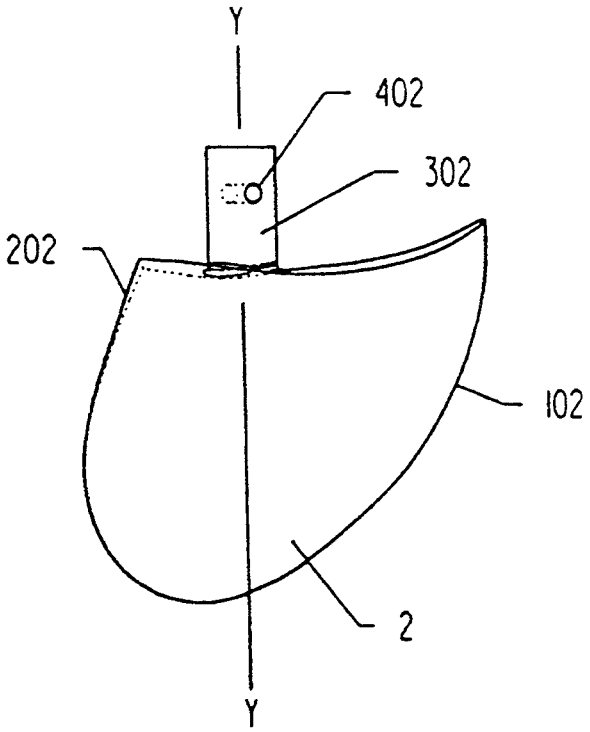
FIG. 32*a* is a side elevation view of a typical propeller blade wherein the shaft is located aft of the blade center of pressure.
Figure 32C:
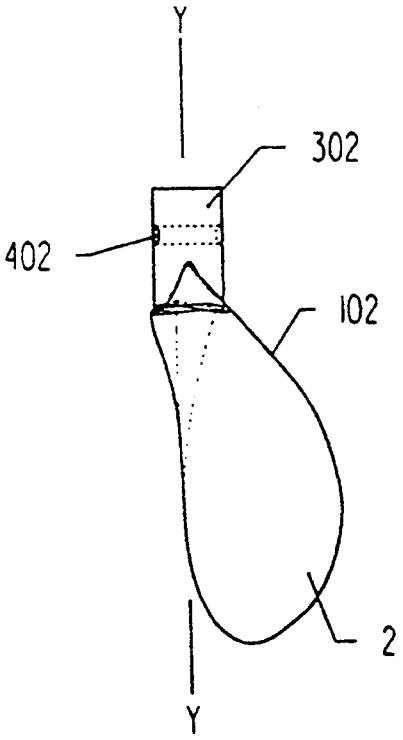
FIG. 32*c* is a front view of the propeller blade in FIG. 32*a*.

In a more preferred embodiment of this invention, detailed in FIGS. 22, 23, 24 and 25, there is provided a control force feedback effect; this effect alters the hold release timing for moving out of the lower pitch position, depending upon the blade hydrodynamic loading. Under the high loads resulting from rapid boat acceleration conditions, the resultant hydrodynamic force is high and the center of pressure is positioned forward, near the aerodynamic center; this results in a high hydrodynamic turning moment about the blade pivot axis, acting to turn the blade toward a higher pitch. This effect arises especially in the more common rearward shaft location propeller, e.g., as depicted in FIGS. 32*a*–32*c*. This turning moment is redirected as a feedback force reaction at the blade arm pin 4, by the canted pocket surface 703, which results in an increase in the centrifugal force required to move the blade 3 longitudinally radially outwardly. The feedback force is generated, e.g., by the geometry of the radially inward cam groove pocket 703 in these figures.

The center line, $C_1$, of the pocket 703 is angled to the opposite side of the sleeve axis Y, than is the major center line of the slot Z, i.e., counterclockwise instead cf clockwise. This geometry requires that the blade, when acted upon by the centrifugal force effect to move outwardly, must rotate towards a lower pitch position until the pin 4 moves out from the pocket 703; thus the initial rotation directed by the surface of the control pocket 703 is opposite to, and is thus opposed by, the torque generated by the hydrodynamic forces. The greater the hydrodynamic force, the larger must be the centrifugal force effect before the pin 4 is moved out of the pocket 703 as the blade moves radially outwardly and is forced to rotate initially towards a lower pitch, until the pin 4 leaves the pocket 703, and then towards a higher pitch. The counter-rotation towards a lower pitch lasts for little more than an instant before it switches towards a higher pitch.

Figure 25:
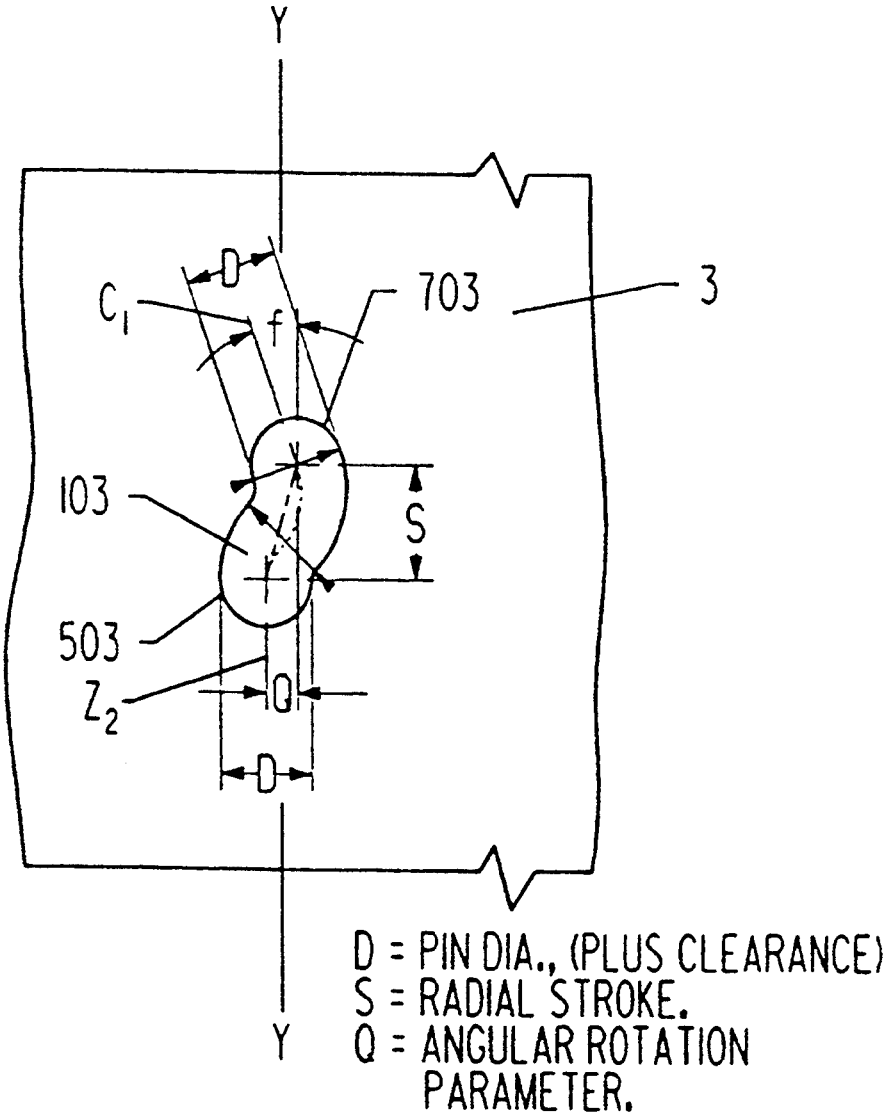
FIG. 25 shows the preferred cam groove 103 geometry viewed as though the cam sleeve were unrolled onto a plane (developed view). This view shows a backward canted pocket for the radially inward, low pitch operational position in combination with a blade shaft axis aligned pocket for the radially outward, high pitch operational position.

The extent of the counter-clockwise rotation need be no more than about 40% of the net rotation between the held low pitch position, i.e., while the pin 4 is held stationary in the inner pocket 703, and the high pitch position, i.e., when the pin 4 is held stationary in the outer pocket 503; a larger counter-rotation, although possible, would be less efficient. Preferably, the counter-rotation is not more than about 30% of the net movement, and preferably at least about 10% of the net movement. The embodiment of FIG. 25 provides a net rotation of about 8°, and a counter-rotation of about 2°.

The cam surfaces of this embodiment of the cam groove slot 103 present substantially no straight lines. The curved sides are necessary because of the large angle coming out of the pocket 703, in order to provide for a smooth, continuous movement of the pin 4, and thus the blade 3. The dashed, curved line intersecting the major center line, Z, depicts the actual movement of the center of the pin 4 along the slot.

According to this preferred embodiment, when the blade 2, having an aft shaft location as shown in FIG. 32 *a–c*, is positioned radially inward and the pin 4 is inserted into the backwards canted pocket 703, force reactions on pin 4 tend to hold the blades radially inward in the lower pitch blade operational position. Thus, the greater the hydrodynamic turning moment on the blade tending towards a higher angle of pitch, the greater the radial inward force holding the blades in the lower pitch operation position. Since the forces tending to move the blades radially outward are generated by the centrifugal force effect acting on the blade mass in response to propeller rotation, a higher propeller rotational speed (RPM) is required in order to overcome the higher hydrodynamic force feedback component under high acceleration conditions.

As the boat speed is increased, the hydrodynamic center of pressure acting on the blades moves aft, thereby reducing the hydrodynamic turning moment, or torque, about the blade shaft axis Y. This, in turn, reduces the radially inward directed force, allowing a lower centrifugal force to move the blade radially outward. This hydrodynamic force feedback has the desirable effect of requiring the engine, and thus the propeller, to accelerate to a higher RPM before the blades can move to a higher pitch during higher power, higher boat-acceleration conditions, than during lower power, slower-boat acceleration conditions.

Figure 24:
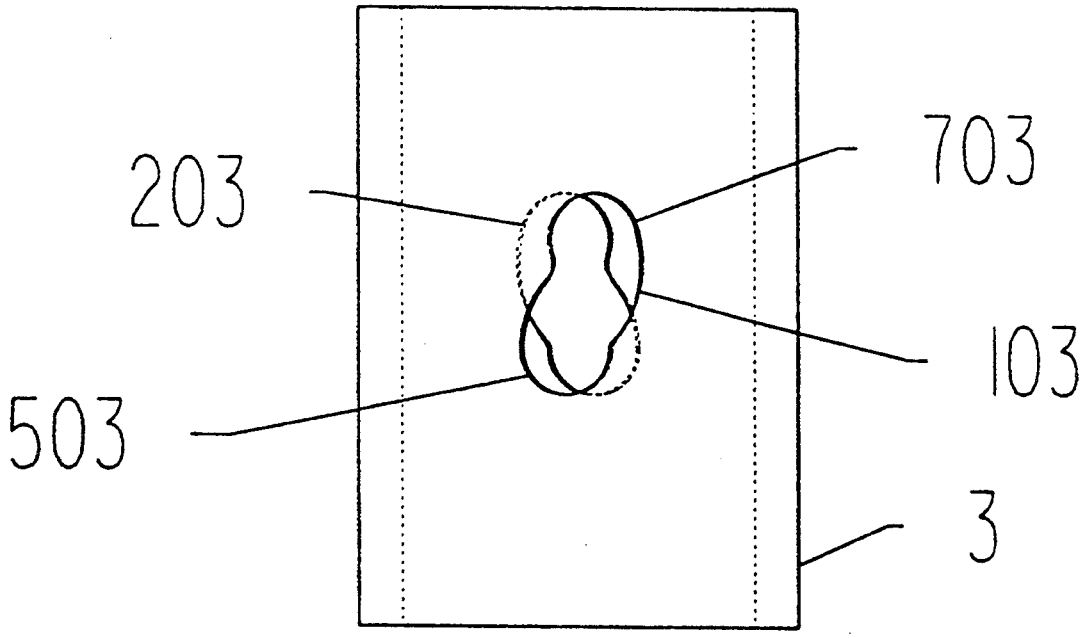
FIG. 24 is an enlarged view of the cam sleeve 3 and groove 103 looking along the axis of pin 4 when positioned in a position intermediate the low and high pitch operational positions.

An enlarged view of the cam sleeve 3, showing the preferred cam groove 103,203 geometry in detail is provided in FIG. 24. This view, looking along the axis of pin 4 when positioned radially inward, in an intermediate pitch transitory position, illustrates the backward canted pocket 703 at the radially inward end of the cam groove 103, and the blade shaft axis, Y, aligned pocket 503, at the radially outward end of the cam groove 103. This groove geometry provided in the cylindrical sleeve 3 can be analyzed, as discussed above, by unrolling this geometry onto a planar surface, thus yielding the developed view of the preferred groove geometry, shown by FIG. 25, i.e., a developed view of one of the opposed groves 103, 203 in the sleeve 3.

In FIG. 25, et seq, the radial displacement, or stroke, i.e., along the blade axis Y, of the pin 4, from the low pitch operational position to the high pitch operational position, is indicated by the letter "S". The radially inward cam pocket 703 has its axis at an angle f, relative to the blade shaft axis Y. Located at the radially outward end of the groove 103, is pocket 503, having its axis in-line, or parallel, with the shaft axis Y. The linear displacement of the pin 4, in the developed views, between the low and high pitch operational positions, resulting from the rotation of the pin 4, is indicated by the letter Q, which is defined as follows:

$$Q=Md$$

Where:

M=desired low to high pitch angular change of the blade, in radians; and d=cam sleeve mean diameter (the average of the inner and outer diameters of the sleeve 3).

The above formula is conventional for converting from a cylindrical system (of the sleeve) to a rectangular system, as in the developed views.

Figure 26:
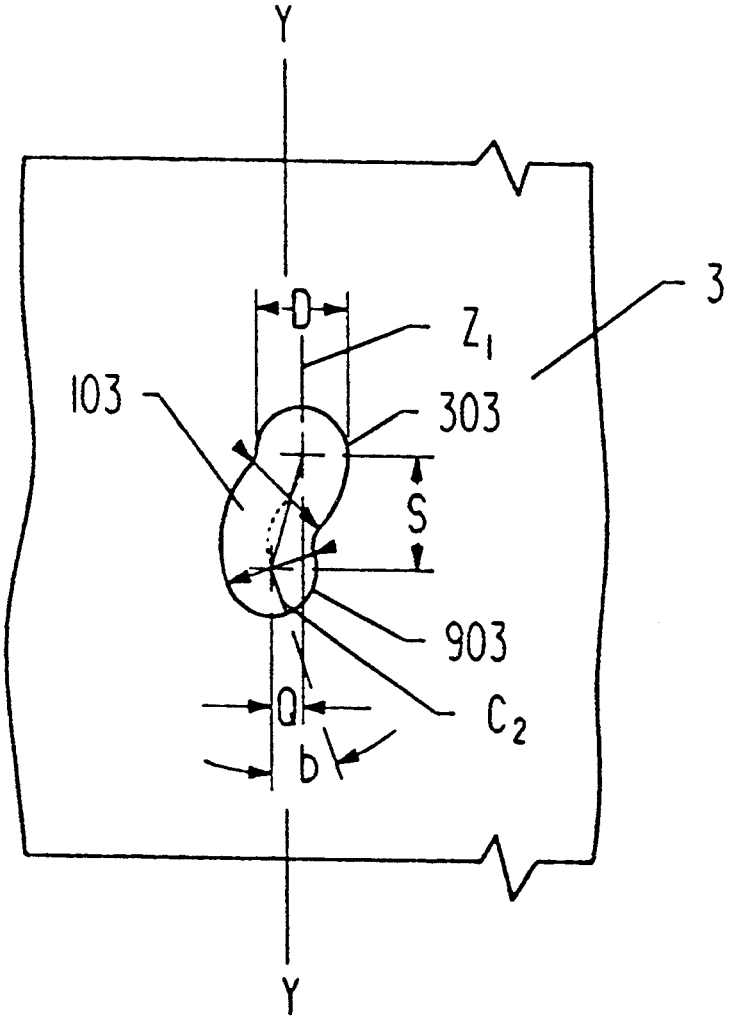
FIG. 26 is a developed view showing an alternate configuration for the sleeve cam groove geometry where a backward canted pocket is provided for the high pitch operational position.
Figure 26A:
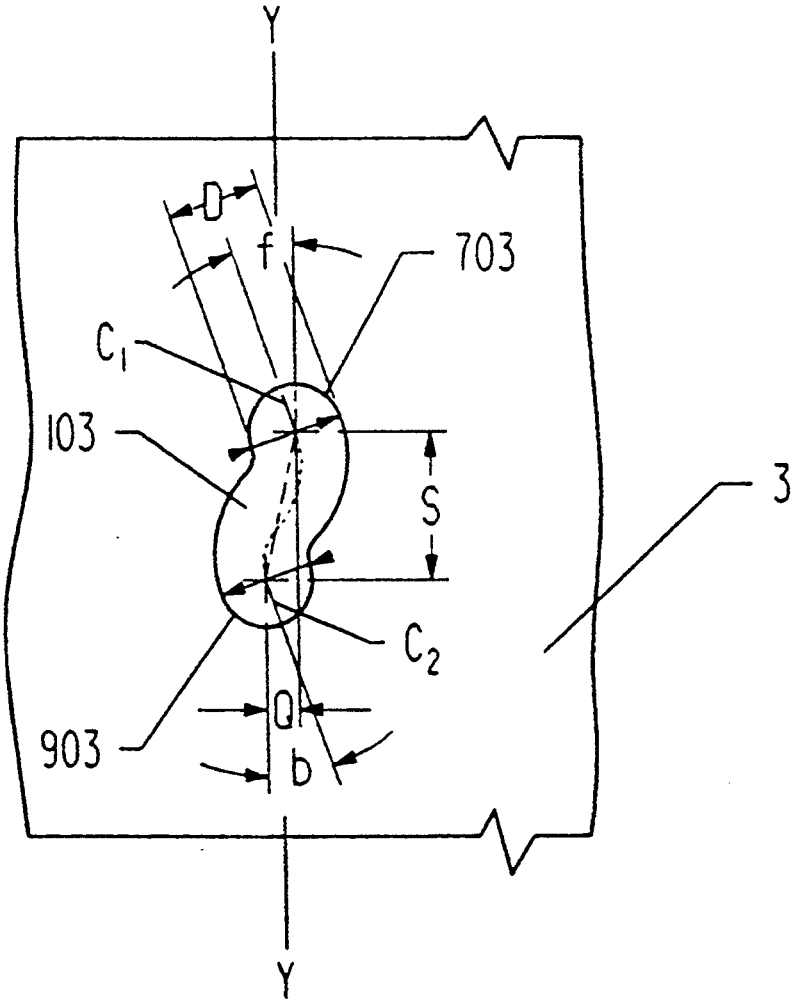
FIG. 26*a* is a developed view showing another alternate configuration for the sleeve cam groove geometry where a backward canted pocket is also provided for both of the high and low pitch operational positions.

Various alternate configurations in cam Groove geometry can also be provided. For example, FIG. 26 shows a backward canted pocket 903 (shown at angle b relative to the sleeve axis) for the high pitch operational position, and FIG. 26*a* shows two backward canted pockets 703,903, one at each of the low and high pitch positions, respectively; FIG. 27 shows an in line pocket for both of the low pitch and high pitch operational positions.

Figure 28:
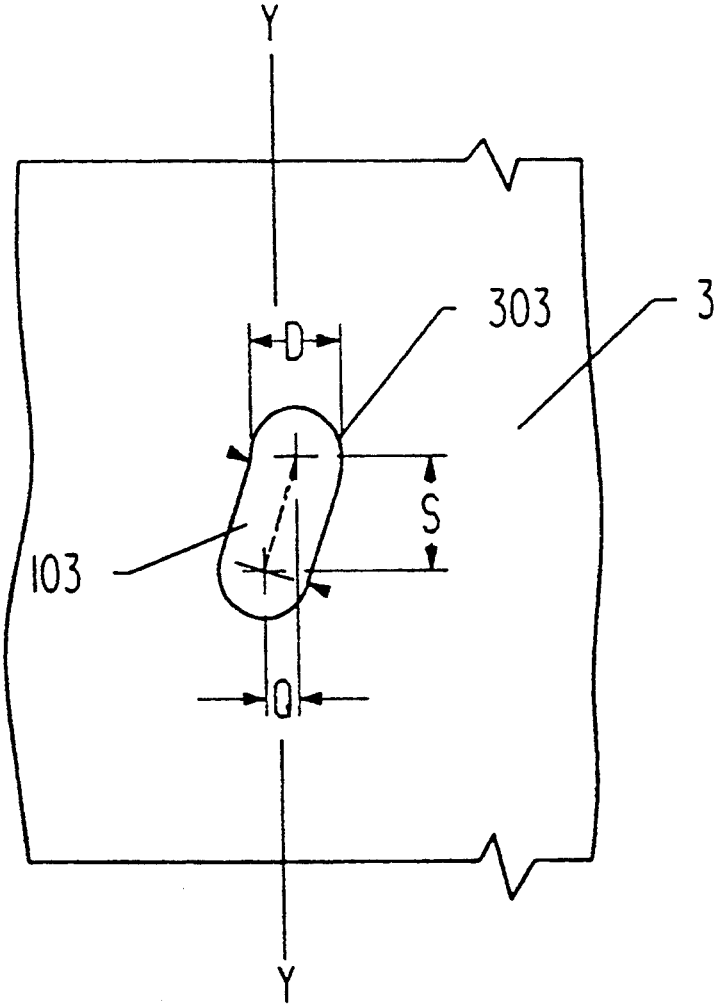
FIG. 28 is a developed view showing an alternative configuration for the sleeve cam groove geometry showing a blade shaft aligned pocket for the low pitch operational position in combination with a radially outward helical groove. (Allowing the propeller to operate as an infinitely variable pitch position device once the blades have been caused to be released from a discrete low pitch position).
Figure 29:
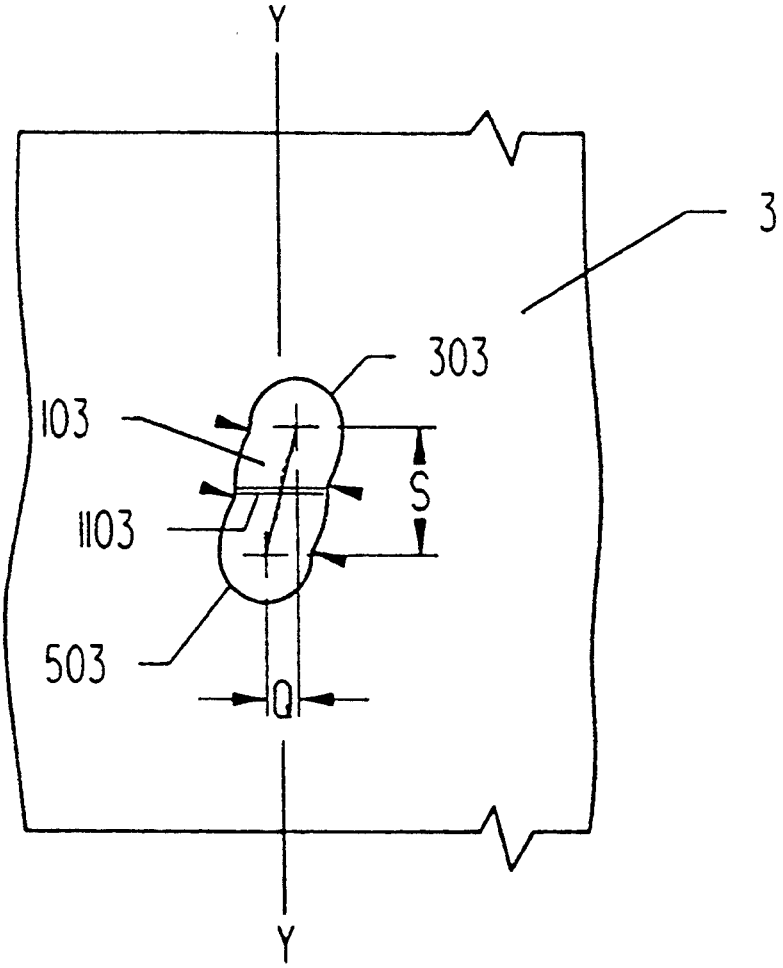
FIG. 29 is a developed view showing an alternative configuration for the sleeve cam groove geometry providing three operable discrete pitch positions.

It should be noted that any combination of one or more discrete positioning pockets can be used depending upon desired propeller operation. For example, as shown in FIG. 28, a single discrete pitch positioning pocket 303, e.g., in the low pitch position, can be used in conjunction with a helical groove to allow the propeller to be operated in infinitely variable pitch positions once the blades have been caused to be released from the discrete low pitch positioning pocket. A plurality of such pockets is especially useful where operational instabilities or inconsistencies are more prone to occur. Furthermore, the number of discrete positions is not limited to two. For example, FIG. 29 shows the radial stroke lengthened to provide three discrete positions, defined by a radially inward pocket 303, a mid stroke dwell region 1103 and a radially outward pocket 503.

Figure 30:
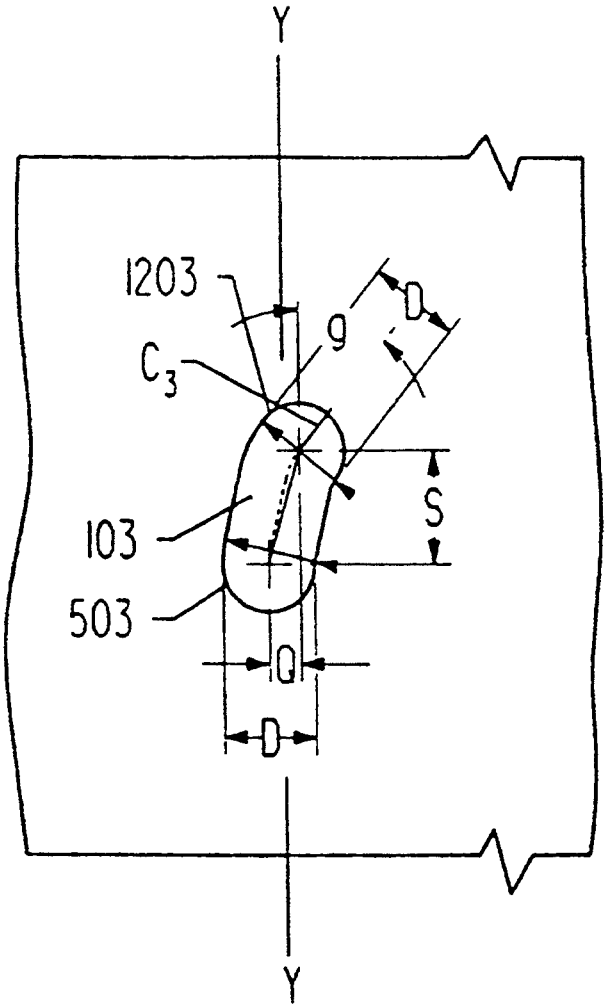
FIG. 30 is a developed view showing a low pitch pocket canted in the opposite direction to the geometry shown in FIG. 25.
Figure 33B:
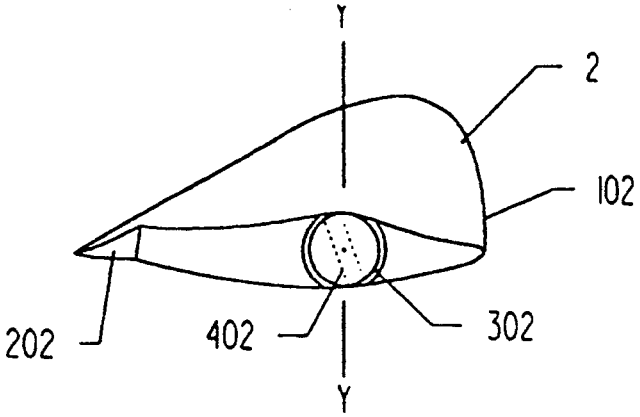
FIG. 33*b* is a top view of the propeller blade in FIG. 32*a*, looking radially outward along the blade shaft axis Y.
Figure 33A:
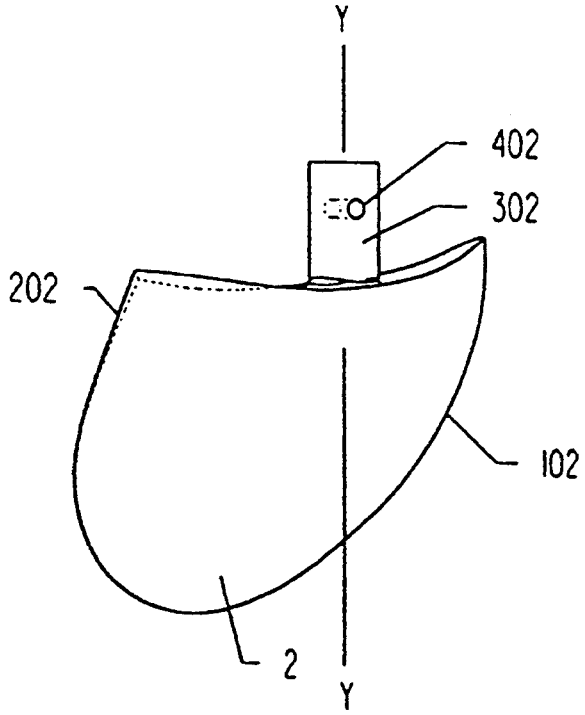
FIG. 33*a* is a side elevation view of a typical propeller blade wherein the shaft is located forward of the blade center of pressure.
Figure 33B:
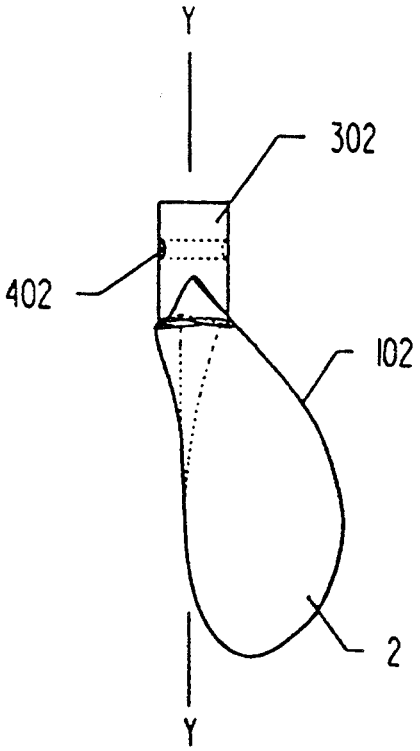

The canned low pitch position cam pocket 703 shown in FIG. 25 generates a radially inward holding force component resulting from the hydrodynamic torque about the blade shaft, if the blade center of pressure acts forward of the blade pivot axis Y as would occur if the blade shafts were positioned rearwardly near the 55% mean aerodynamic chord position, such as is shown in FIGS. 31*a*, 32*a* and 33*a*. It is also possible to configure a pocket canted at angle g, in the opposite direction of the angle f shown in FIG. 25, relative to the blade shaft axis Y. This opposite cam pocket 1203, shown in FIG. 30, provides a radially inward holding force component from a hydrodynamic torque about the blade shaft, if the center of pressure acts aft of the blade pivot axis Y, as would occur if the blade shafts were positioned forwardly, near the 25% mean aerodynamic chord position, such as is shown in FIGS. 33*a*, 33*b* and 33*c*. Thus, the propeller pitch change operation can be tailored by variations in cam groove design and blade shaft location, relative to the hydrodynamic surfaces.

One example of the mechanical elements of this invention is shown by the embodiment of this invention, shown in FIGS. 2 through 11. A winged collar 5 is inserted over each sleeve 3, and the sleeves 3 are installed into the hub depression 501. The collar 5 and sleeve 3 are both connected to each blade shaft 302 by a pin 4. According to this arrangement each of the collar 5, the pin 4 and the blade shaft 302 become an integral assembly, so that each collar 5 moves both rotationally and translationally with its respective blade shaft 302. The collar 5 has two lateral sideways appendages 105, 205 which coact with the depressed surfaces 701, 801 in the hub case inner surface to retain the compression springs 15 and 16, respectively. The compression springs 15, 16 act to bias the collar 5, pin 4 and blade 2 assembly radially inward. As depicted, each blade is preferably connected in this manner to a biasing assembly; FIGS. 6–11 are cut away for ease of reference and show only one of the biased assemblies.

To insure that the blades move in unison, it is desirable to provide a means to coordinate the movements cf all of the blades, three in this embodiment. A coordinating ring 14 is provided for this purpose, which is held within the hub case between the hub web 301 and a retaining ring 19 biasedly held within a depression 1502. Three radially inwardly extending bosses 114 are rigidly secured to the inner surface of the coordinating ring 14, each defining a channel pocket 214.

A tooth 305 is secured to the rear collar appendage 205; the tooth 305 is engaged into the channel 214 within one of the bosses 114. The springs 15 and 16 are so configured to bias the collar 5, and thus the blade 2, radially inward. The interaction between the cam groove 103 and the pin 4, in turn, positions the blades 2 in the low pitch rotational position, wherein the pin 4 is held against the radially innermost cam surface, e.g., pocket 703, in FIG. 27.

If the cam grooves 103 and 203 are configured with the non-canted pocket 303,503 design (FIG. 27), the operation of this invention is as follows: Upon increasing the propeller rotational speed (RPM), radially outward centrifugal forces acting on the blade 2 (and thus the collar 5) are generated, which oppose the inward bias force generated by the springs 15 and 16. Torque and bending force components about the blade shaft 302, are also generated as a result of hydrodynamic and other loads acting on the propeller. (These loads are described more fully in U.S. Pat. No. 4,929,153 by Speer). Components of these additional forces, carried through the sleeve 3, cam grooves 103 and 203 and pin 4, result in an additional friction impedance to any motion of the blade shaft 302. In the low pitch operational position, any hydrodynamic torque about the blade shank 302 is resisted by the pin 4 bearing against the surface of the inner pocket 303.

Upon attaining sufficient propeller rotational speed (RPM), the radially outward centrifugal force generated on the blade 2—collar 5 assembly mass is sufficient to overcome the inward biasing force provided by the springs 15 and 16, as well as any friction impedance, thereby causing the blades to move radially outward. Once the pins 4 move radially out of the pockets 303, the blades also are caused to be rotated toward a higher angle of pitch, as the pin 4 is constrained to follow the cam grooves 103 and 203. If the hydrodynamic center of pressure acting upon the blades is forward of the blade shaft axis Y (FIGS. 32*a–c*), the hydrodynamic loads assist in pulling the blades toward the higher pitch position, once the blade pins 4 have moved out of the inner cam pockets 303.

Radially outward movement of the blades causes the springs 15 and 16 to be further compressed between the lateral collar appendages 105, 205 and the hub pockets 701, 801, respectively. The coordinating ring 14 is caused to rotate about the hub axis, if any of the blades 2 rotates, as a result of the collar tooth 305 mating with the coordinating ring boss channels 214. The rotation of the coordinating ring 14 thus provides for synchronized motion by all of the blades 2.

In the most radially outward position of the cam groove 103, in one preferred embodiment, the pin 4 is also positioned in a cam groove pocket 503 to also hinder movement of the blades 2 out of the high pitch operational position until there is a substantial reduction in propeller RPM as a result of any reversal in direction of blade hydrodynamic loading.

Upon reduction of propeller rotational speed (RPM), the radially outward centrifugal force components decrease; and upon being reduced to a minimum threshold value, the radial inward bias force provided by springs 15 and 16 is sufficient to return the blades into the low pitch operational position, and the pin 4 back into the inner pocket 303.

In an alternate embodiment of this invention, shown in FIG. 12 through 21, a different collar mechanism is employed. In this embodiment, a collar 6 is also positioned about each blade shaft sleeve 3, but this collar 6 defines slots 106, 206 therethrough, into which slide blocks 7 are inserted, and the collar 6 comprises split lateral appendages 306, 406. The pin 4 is then positioned through holes in the slide blocks 7 and through the blade shaft hole 402. The slide blocks 7 form a tight but slidable fit radially with the slots 106, 206, and are free to move circumferentially, but not axially, within the slots 106, 206. In this arrangement the blade shaft 302, pin 4 and slide blocks 7 become an integral assembly. The slots 106, 206 provided in the collar 6, interacting with the blocks 7, cause the collar 6 to translate radially outward or inward with the blade shaft 302 and the pin 4 and slide block 7 assembly, but the collar 6 does not rotate with the blade shaft 302.

At the forward end of the collar 6, link 10 is pivotally connected via pin 8 with the split front-appendage 406. The opposite end of each link 10 is pivotally connected to a forward, translating coordinating ring 22 via pin 12 at one of three bosses 122. At the rearward end of the collar 6, link 11 is pivotally connected via pin 9 to the rear appendage 306. The opposite end of each link 11 is pivotally connected to a rearward translating coordinating ring 23 at one of three bosses 123.

In the forwardmost section of the propeller hub 1 are a set of three bosses 120 (rigidly connected to the hub case 1) opposite the three ring bosses 122. A spring 17 is compressed between one of the bosses 120 and one of the bosses 122 on the forward coordinating ring 22, such that the biasing force generated by the springs 17 tends to push the forward coordinating ring 22 rearwardly. Similarly in the rearward most section of the propeller hub 1 are a set of three bosses 121 (rigidly connected to the hub case 1) opposite the three ring bosses 123. A spring 18 is compressed between one of the bosses 121 and one of the bosses 123 on the rearward coordinating ring 23, such that the biasing force generated in springs 18 tends to push the rearward coordinating ring 23 forward. The mechanism connection via the links 10 and 11 between the coordinating rings 22, 23 and the collars 6 results in a spring biasing force reaction pushing the two coordinating rings 22, 23 towards each other, and causing the links 10, 11 to push the collar 6 radially inward.

The operation of this embodiment of this invention is as follows: With the propeller at rest or at a very low rotational speed (RPM), springs 17 bias the forward coordinating ring 22 to its rearward most position, and springs 17 bias the rearward coordinating ring 23 to its forward most position. The links 10 and 11 correspondingly position the collars 6 at their most radially inward position, and thus, the blades are also in their most radially inward position; the cam grooves 103, 203 correspondingly position the blades 2 in their low pitch operation position.

Upon increasing the propeller rotational speed (RPM), an increasing radially outward, centrifugal force acting on the blade 2 is generated. This radially outward force is transferred from each blade 2 through the pin 4, to the slide block 7 and to collar 6. Components of this radial outward force (together with an additional component arising from the collar 6 mass) is transferred via links 10 and 11 to longitudinal force components acting against the springs 17 and 18.

Upon attaining sufficient propeller rotational speed (RPM), the radially outward, centrifugal force generated results in a longitudinal force component that is sufficient to overcome the biasing force of the springs 17, 18, as well as any frictional impedance, thereby causing the blades to move radially outward. The operation of the pin 4 in the cam groove design variations, including the pockets at each end, in the sleeves 3, is the same as those previously described for the embodiment of FIGS. 2–11. As the blades 2 move radially outward, the blades also rotate toward a higher angle of pitch, following the cam grooves 103 and 203 acting against pin 4. The slide block 7 also rotates with the blade 2, and rotatably slides within the slots 106, 206 provided in the collar 6. The collar 6 can then translate radially outward, without rotating about the blade shaft axis Y. As the collar 6 translates radially outward, the forward coordinating ring 22 is caused to move longitudinally forward along the propeller shaft axis X, via link 10, while the rearward coordinating ring 23 is caused to move longitudinally rearward along the propeller drive shaft axis X via link 11, compressing the springs 17, 18 respectively. Ultimately, the blades 2 positioned at their most radially outward position and in the high pitch operation position, while the springs 17, 18 are placed in their most compressed condition; the pins 4 are then stopped at the radially outward most end of the cam slots 103.

The coordinating rings 22 and 23 provide an interconnection among all of the blade mechanisms, thereby providing a synchronous motion by all the blades 2. It should be noted that providing both a forward coordinating ring 27 and a rearward coordinating ring 23 is somewhat redundant; however, the force symmetry provided by the arrangement can result in smoother, more consistent operation.

Upon reduction in the propeller rotational speed (RPM), the radially outward centrifugal forces along with their longitudinal force components are decreased, and upon attaining a minimum threshold value the longitudinal bias forces acting on the coordinating rings 16 and 15, provided by springs 17 and 18, become sufficient to return the blades 2 and associated mechanisms back into the low pitch operational position.

Figure 22:
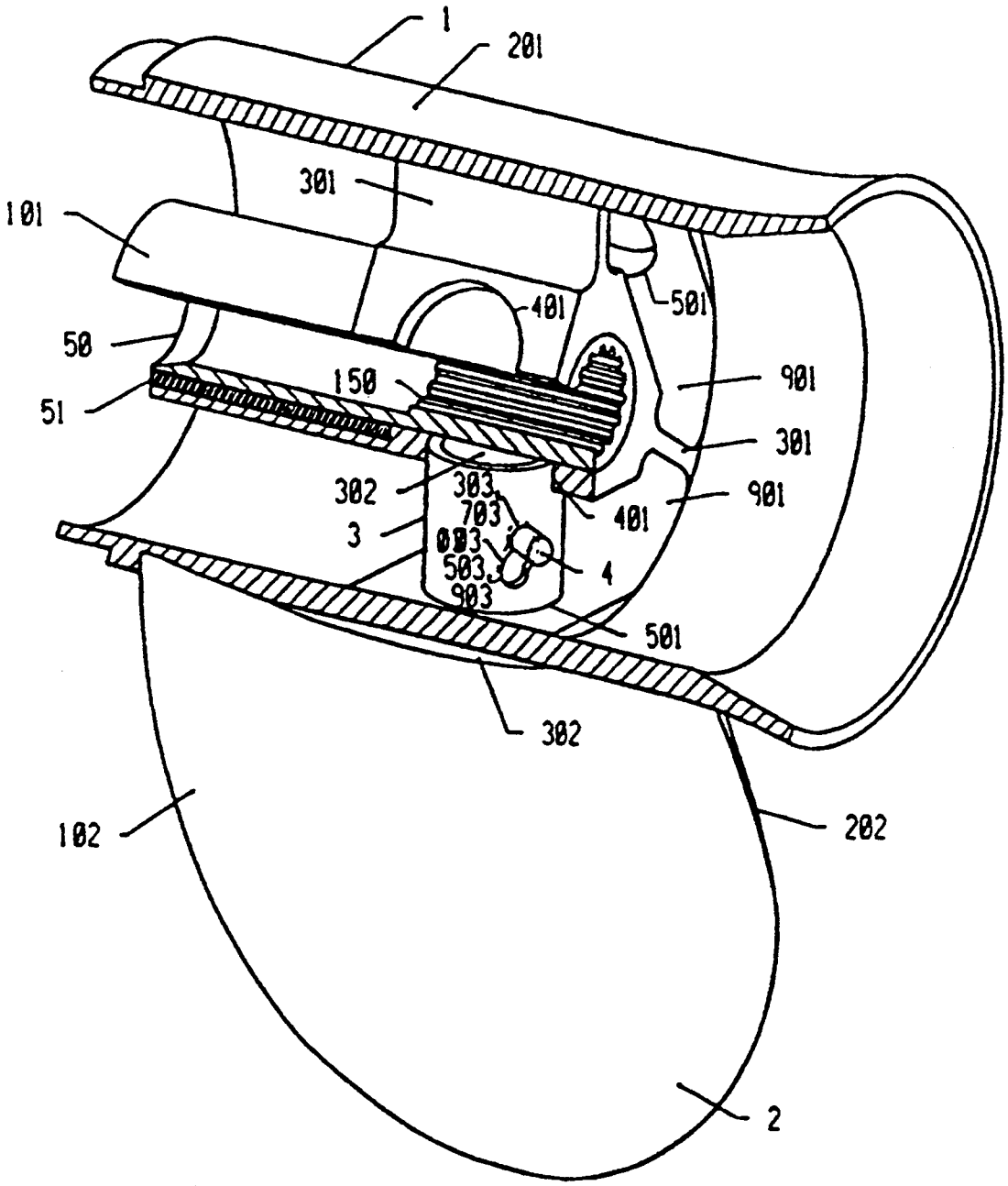
FIG. 22 is a partial aft end view with most of the mechanism removed to show the cam sleeve and pin follower geometry for one blade in the low pitch operational position.
Figure 23:
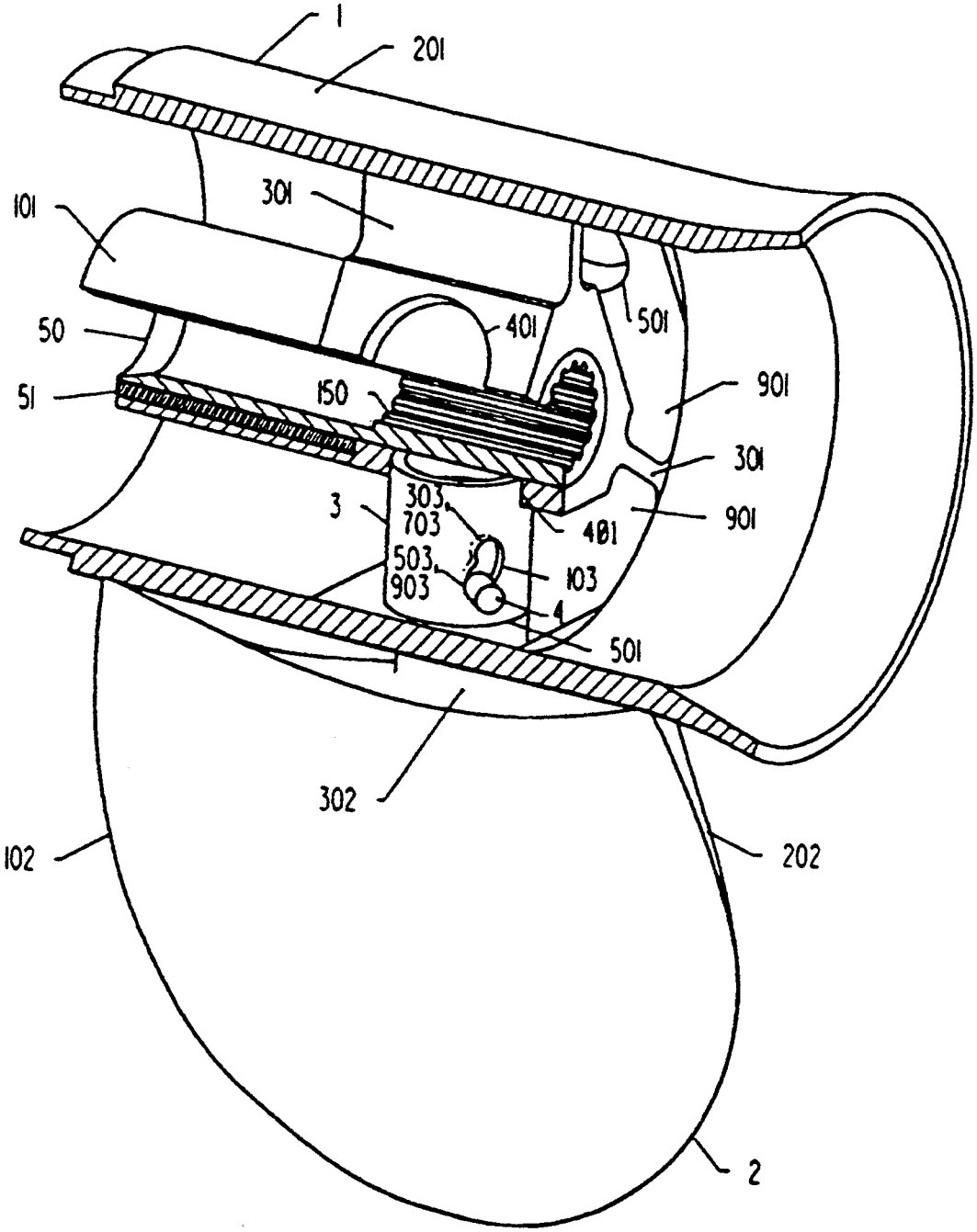
FIG. 23 is a partial aft end view with most of the mechanism removed to show the cam sleeve and pin follower geometry for one blade in the high pitch operational position.

Provisions for a flexible connection between the propeller and drive shaft can be incorporated into the propeller hub. An example, shown in FIGS. 22 and 23, provides a separate internal splined member 50, which is attached to the hub inner region 101 by a generally cylindrical elastic member 51. The splines 150 are mated with matching splines on the drive shaft, with the imposed shaft torque being transferred from the splined member, 50 through the elastic member 51, to the propeller hub 1.

These drawings show preferred embodiments comprising a cam holding and positioning mechanism associated with each blade, e.g., a total of three blades, a spring return mechanism and one or two coordinating mechanisms. However, the number of blades and mechanisms need not be equal to three, or equal to each other. Also, the several cam pocket cant angles (f, b and g), for the inner and outer radial ends of the cam slots 103,203, respectively, and the backward cant angle, need not be equal.

FIGS. 34 through 39 and 39*a* show a further alternate embodiment of this invention, wherein the blade positioning and holding cam mechanism is replaced by a linkage mechanism, generally indicated by the numeral 1103. In this embodiment each blade shaft 302 moves both pivotally and radially within a sleeve bearing 33, which is rigidly attached to the inner surface of the hub case 1. Each sleeve 33 contains clearance grooves 133, 233 through which a retaining pin 4 is inserted, without contacting the side of the groove. A collar 55 having a similar arrangement to collar 5 shown in FIGS. 2–11, fits around the blade shaft 302; the collar 55 and the blade shaft 302 are rigidly connected together by the pin 4. Compression springs 15 and 16 are inserted into the pockets 701 and 801 respectively located in the inner surface of the hub case 201, as shown in greater detail in FIGS. 2–11 The collar 55 also has lateral appendages 155 and 255, into which the radially inward end of springs 15 and 16 are inserted; the springs 15, 16 act to bias the collar 55, and the blade assembly, radially inward, i.e. to the preferred low pitch position.

The locking, positioning linkage mechanism 1103 comprises, for each blade mechanism 1103, a pair of support lugs 1001, 1101 rigidly attached to the inner hub 101. Elongated link 60 and tricorner link 61 are each pivotally connected to a hub support lug 1001, 1101, respectively, by pins 43 at one apex; a second apex of each of links 60 and 61 is connected to the blade shaft pin 4 via a spherical-cylindrical joint, generally designated as 64; the third corner of the tricorner link 61 is linked to a coordinating ring 44. The arrangement of the spherical-cylindrical joint 64 is such that the pin 4 can slide longitudinally within the spherical joint ball 64, and the joint ball 64 can rotate within the link 60,61, as the links 60 and 61, rotate about an axis parallel to the axis of the propeller, X.

As with the other embodiments, the motion imposed by this mechanism is such that when the centrifugal force effect load acting on the blade mass becomes sufficiently high, the blades 2 tend to move radially outward, along the blade axis Y. As the blade shaft 302 moves outward within the sleeve 33, the links 60 and 61, as a result of their axially slidable, spherical, or universal, joint connection to pin 4, cause the blades to rotate toward a higher angle of pitch as shown in FIGS. 34 and 35.

Figure 34:
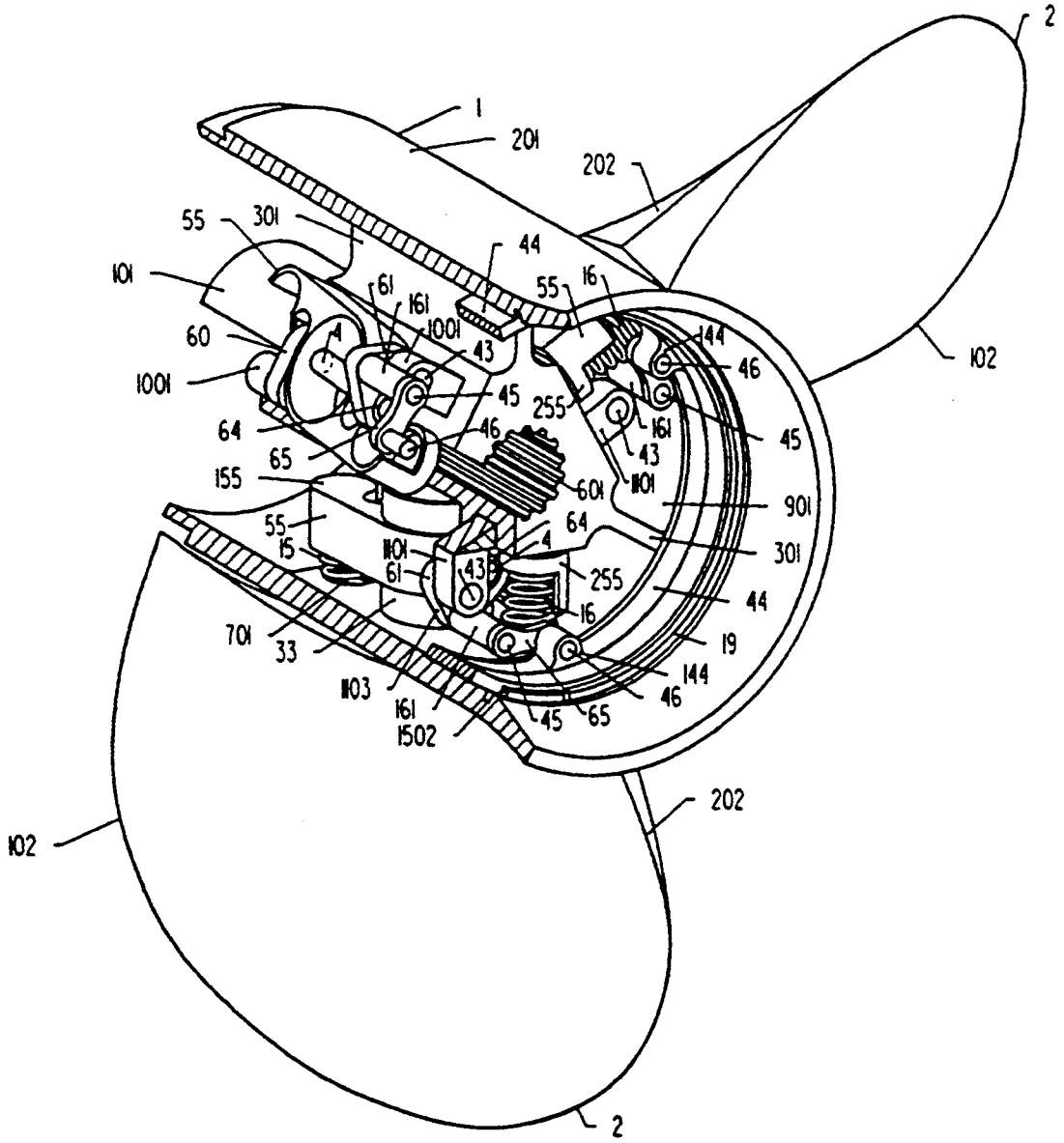
FIG. 34 is a sectional isometric view of a third embodiment of this invention with the internal mechanism in the low pitch position.
Figure 35:
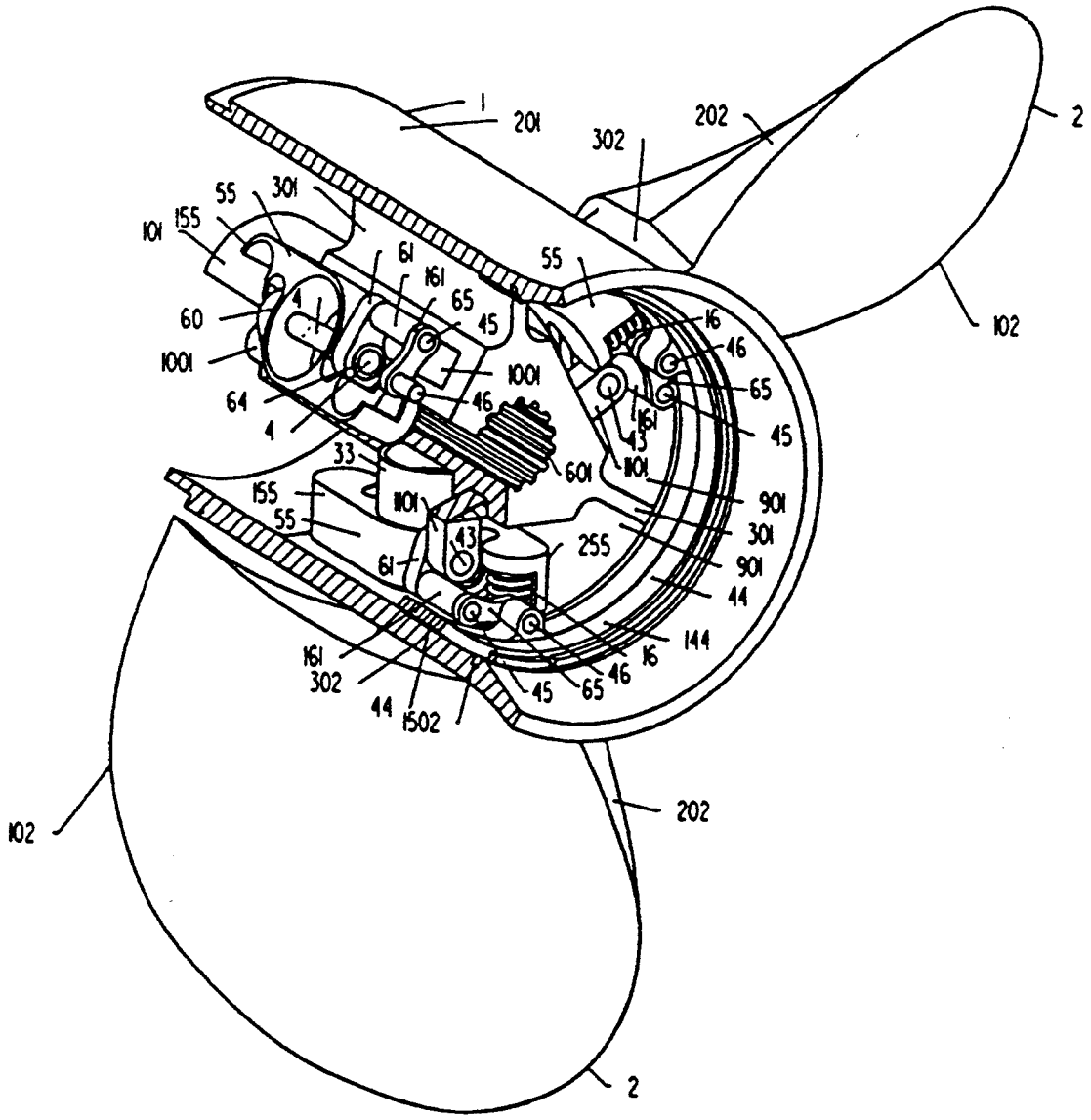
FIG. 35 is the same embodiment as FIG. 34, in the high pitch position.
Figure 36:
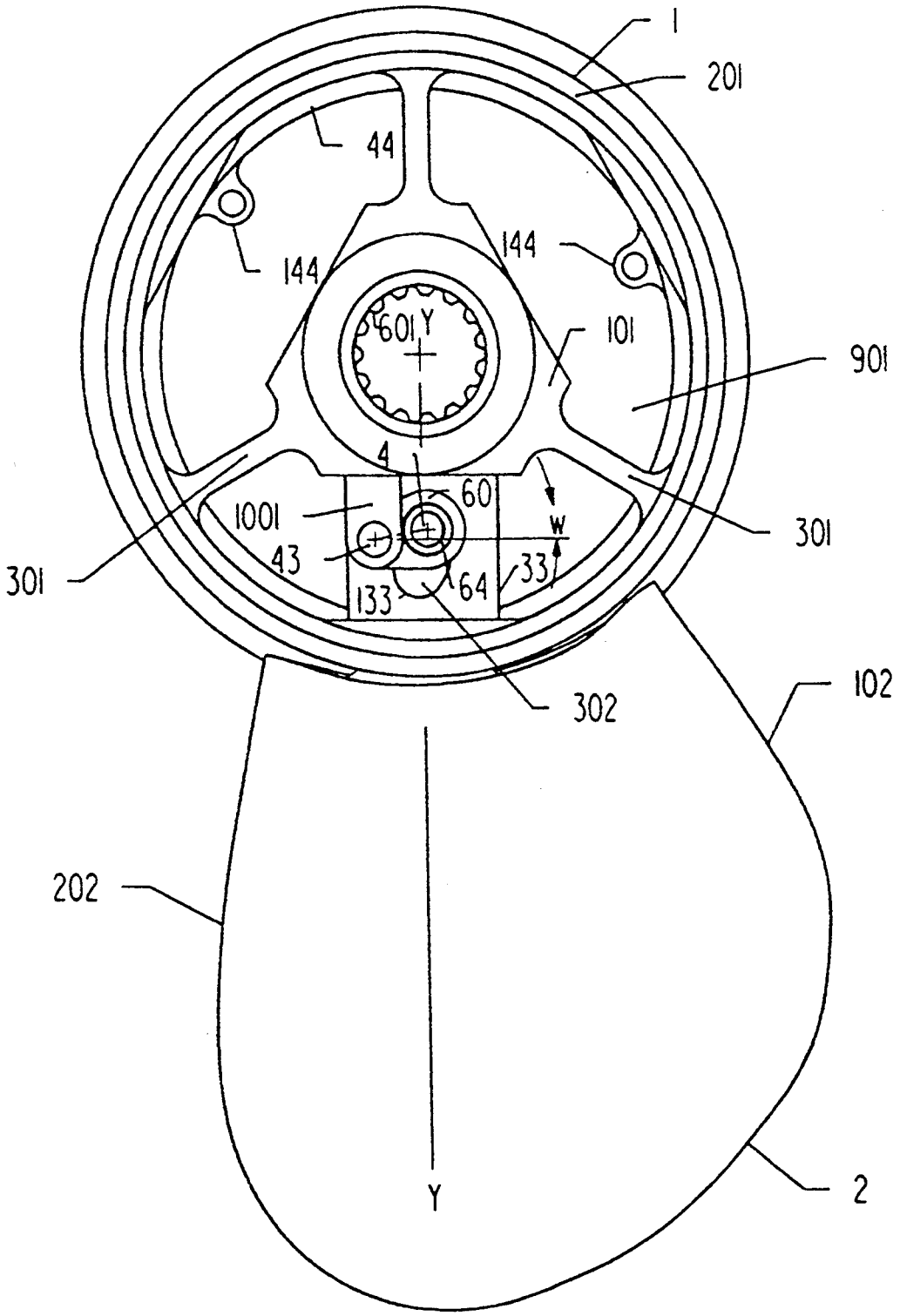
FIG. 36 is a partial rear view of the propeller assembly of FIG. 34, of a single linkage mechanism in the low pitch position.
Figure 37:
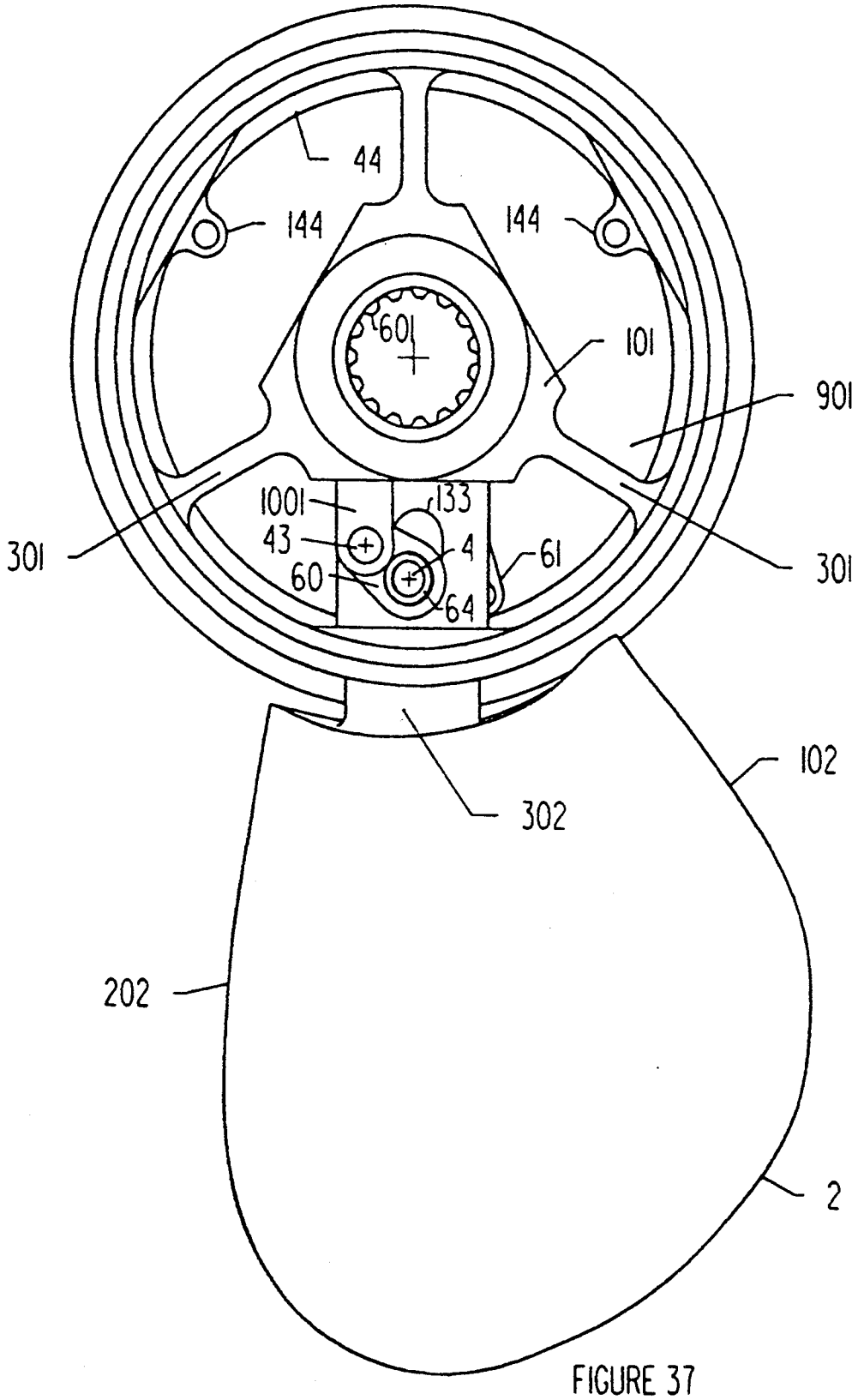
FIG. 37 is the view of FIG. 36, in the high pitch position.
Figure 38:
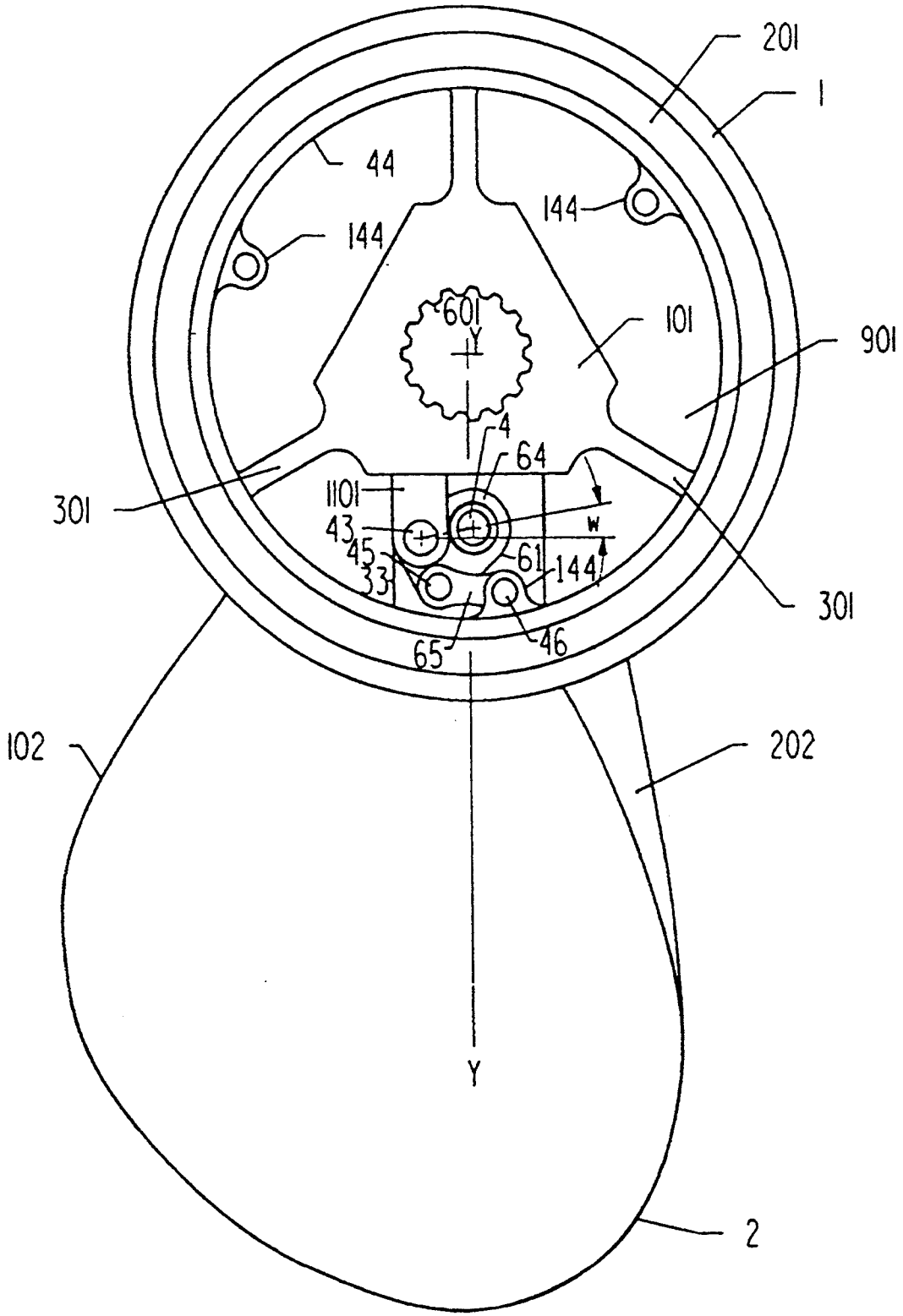
FIG. 38 is a view looking rearwardly at the linkage mechanism of FIG. 34, from a position forward of the sleeve.
Figure 39:
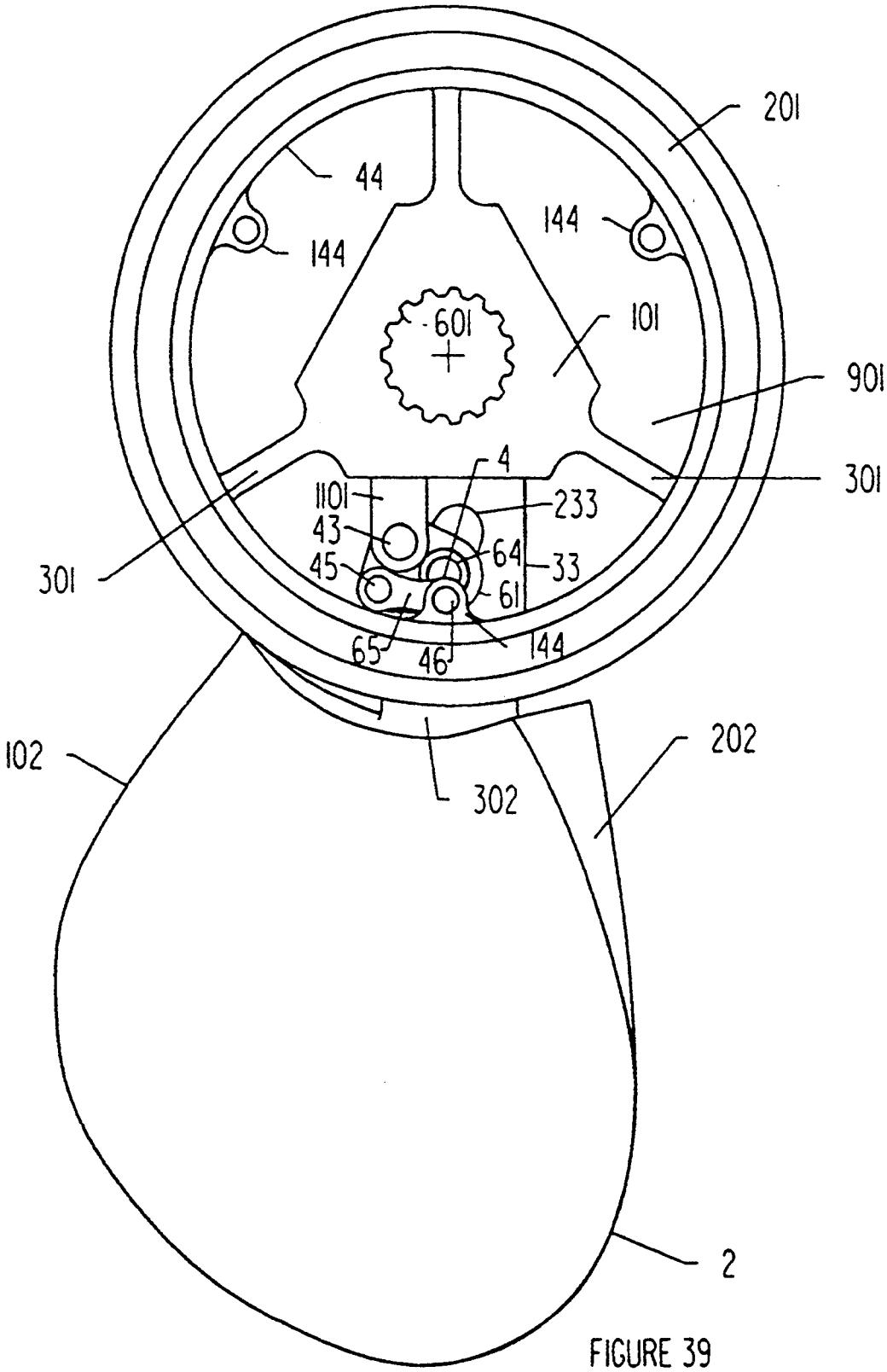
FIG. 39 is a view looking rearwardly at the linkage mechanism of FIG. 35.
Figure 39A:
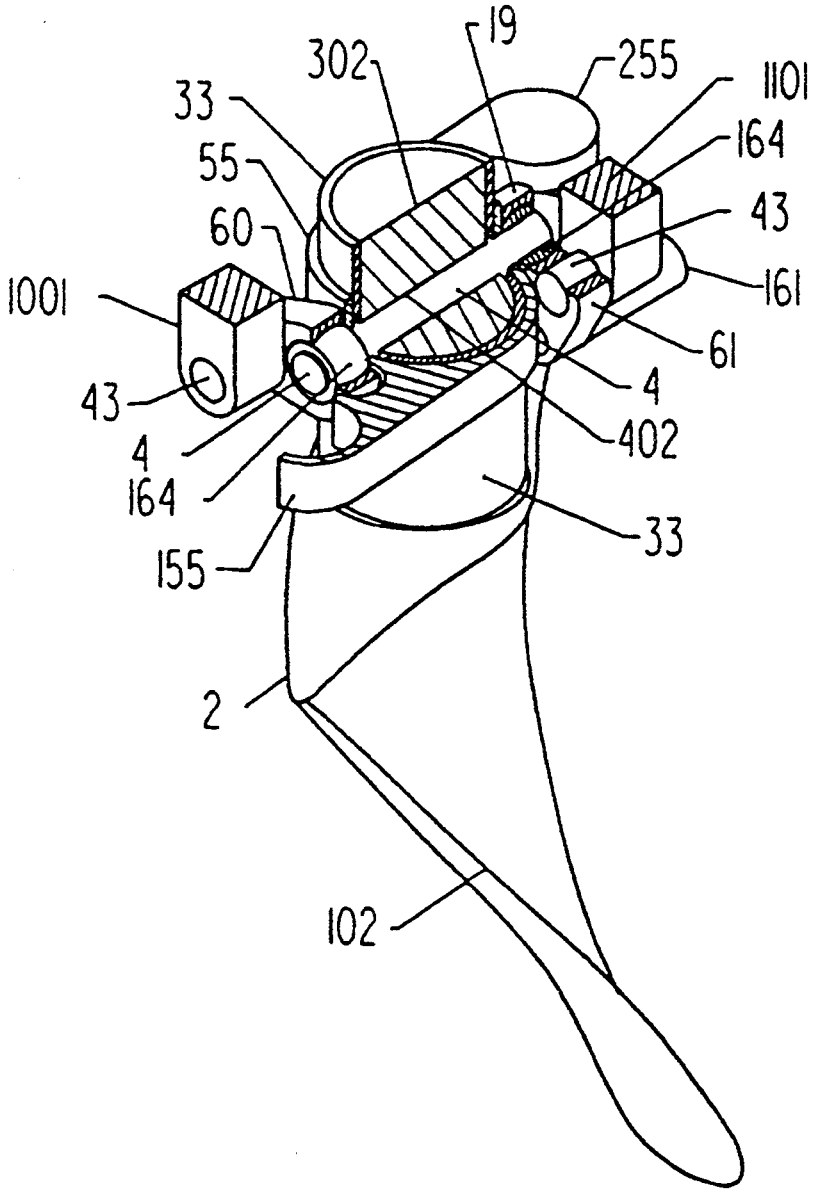
FIG. 39*a* is a random isometric section view of the internal mechanism of FIG. 34, in the low pitch position.

The linkage geometry is arranged so that in the low pitch operational position, FIG. 34, the center of each of the spherical-cylindrical joints 64 connecting the blade shaft pin 4 to each of the links 60 and 61, is positioned radially inward (over-center), at an angle "W" relative to a line drawn thru the center of pin 43 and normal to the blade shaft axis Y. This overcenter positioning of the spherical-cylindrical joints 64, results in a redirecting of the resultant forces arising from blade hydrodynamic loads to create a bias force directing the blades radially inward, when the blade center of pressure acts forward of the blade shaft axis Y. In a manner, similar to that described for the embodiment of FIGS. 2 through 11, a larger centrifugal force, hence higher propeller RPM, is required to move the blades radially outward against the hydrodynamic torque bias force, generated about the blade shaft 302 by hydrodynamic forces acting forward of the blade shaft axis Y, as occurs when the propeller, and the boat, are accelerated.

The inwardmost radial position of the blade shaft 302 determines the magnitude of the overcenter angle w. This position can be established by the radially inward end of the blade shaft 302 on collar 55 butting against the inner hub surface 101. The radially outwardmost position can be limited by the radially outward edge of the collar 55 contacting an inner surface of the outer hub 201. Alternatively, low and high pitch stop adjusting can be provided in the hub or collar to allow field adjustments of these pitch limiting positions. Preferably the overcenter angle w has a magnitude of at least about 5°; the magnitude of the angle w preferably is not greater than about 20°.

A boss 161 is rigidly attached to each rear link 61 to provide a linkage connection to a coordinating ring 44. To accomplish this, the link 65 is pivotally connected via pin 45 to the boss 161. The opposite end of the link 65 is pivotally connected to the coordinating ring 44 at a boss 144 via a pin 46. The interconnection of each of the links 61 with the coordinating ring 44 via links 65 provides the interconnection to cause all of the blades 2 to move in unison; the coordinating ring 44 is caused to rotate about the drive shaft axis, moving all of the blades together.

Figure 40:
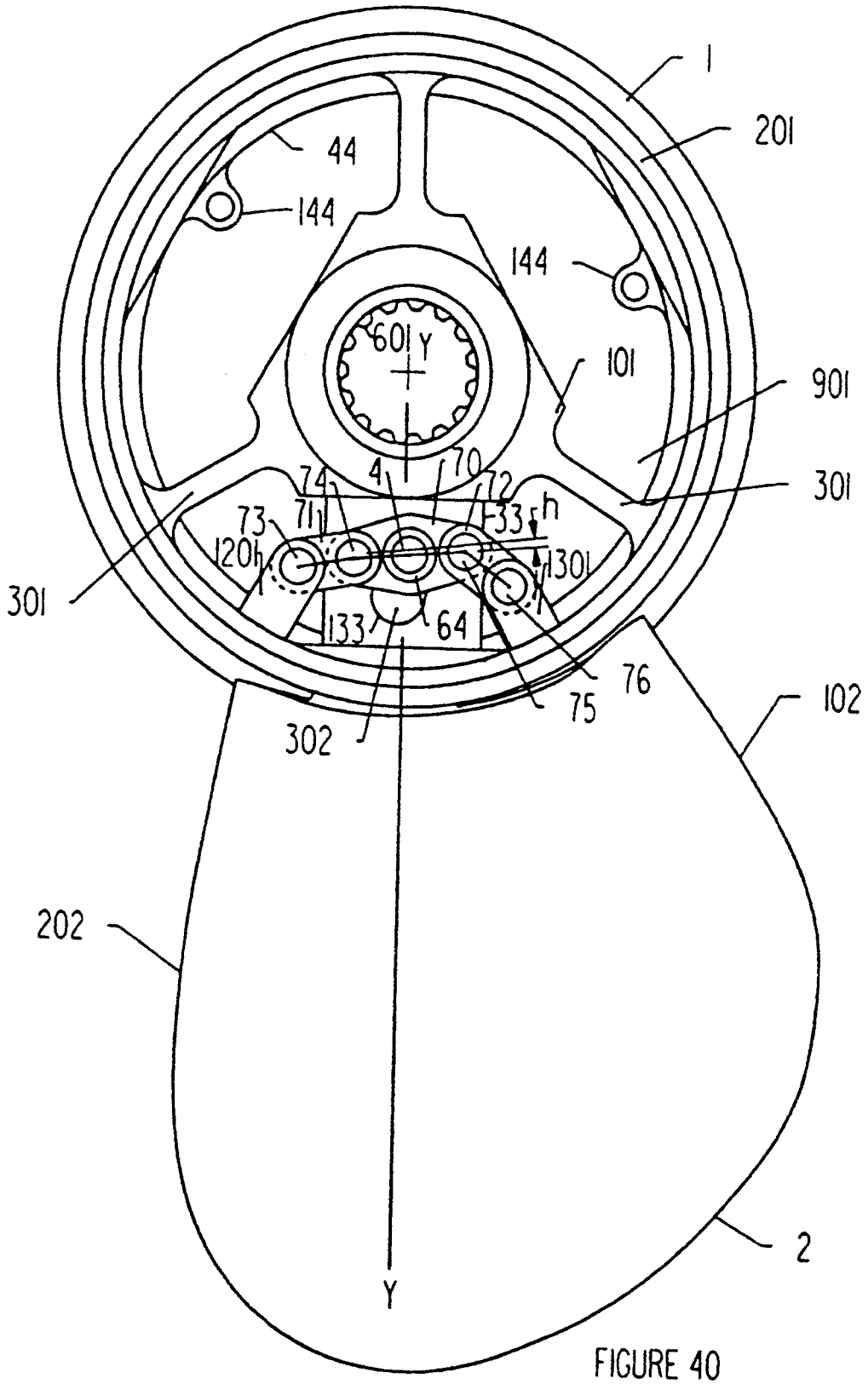
FIG. 40 is a partial rear view of a further embodiment of a multiple linkage holding mechanism, in the low pitch position.
Figure 41:
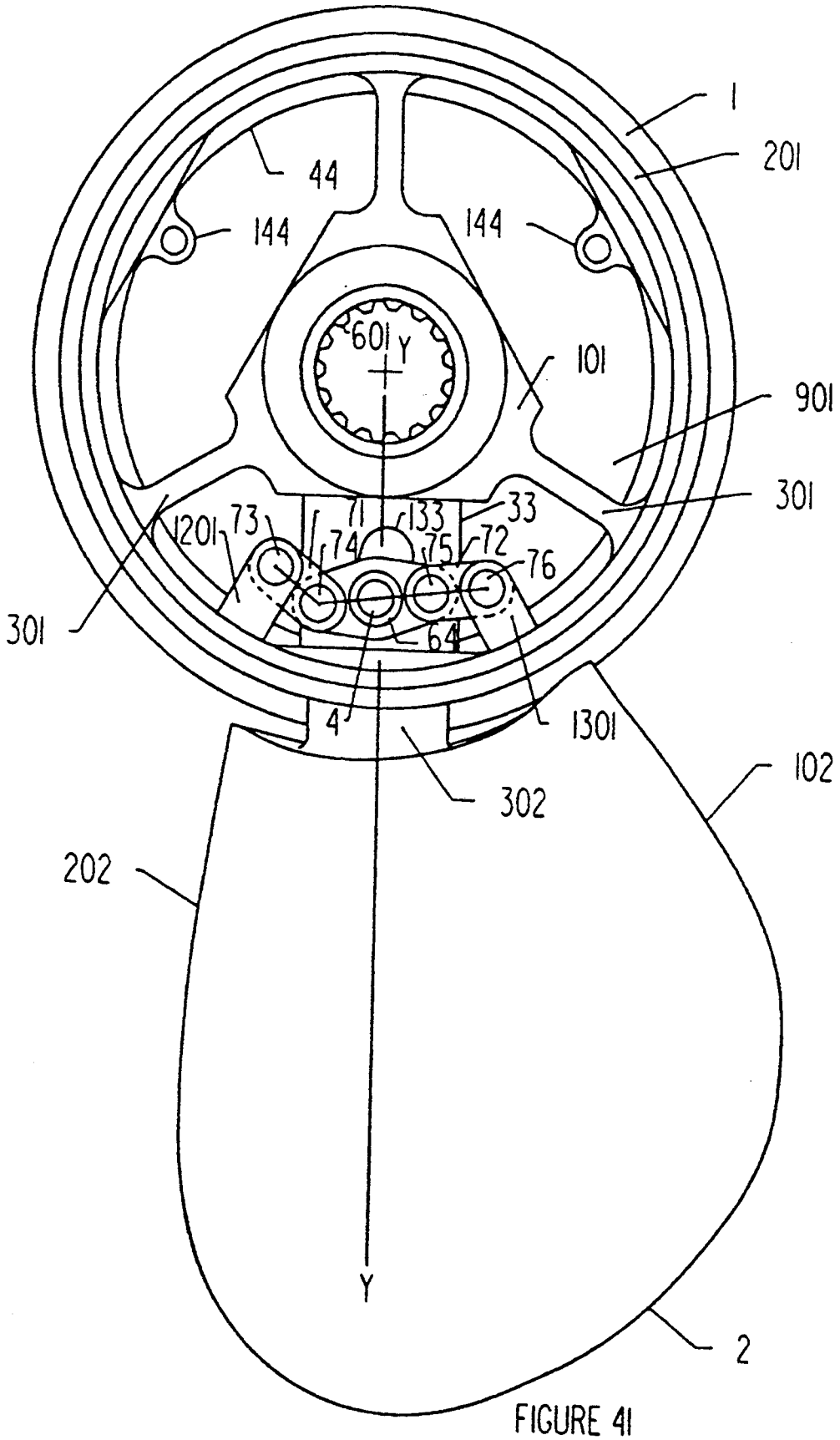
FIG. 41 is the same embodiment as FIG. 40, in the high pitch position.

The embodiment shown in FIGS. 40 through 41 provides means to lock, or hold, the blades in the lowest pitch operational position and in the highest pitch position. In this embodiment, links 60 and 61 are replaced with the bellcrank links 70, on each side of the sleeve 33. At the central portion of the bellcrank 70, is a spherical-cylindrical joint, generally indicated as 64. In a similar fashion to the other linkage embodiment described above (FIGS. 34–39), the ball joint 64 is contained within a socket provided in the bellcrank 70; the ball 64 also contains a cylindrical channel in which the blade shaft pin 4 is inserted in a slidable fit, allowing both pivotal and slidable motion of the pin 4 by and within the ball 164. At one end of the bellcrank link 70, a second pin 74 pivotally connects the bellcrank 70 to a midlink 71, and at the other end pin 75 pivotally connects the bellcrank 70 with a second midlink 72. The other end of link 71 is, via an anchor pin 73, pivotally connected to a boss 1201 which is rigidly attached to the outer hub case 201. Similarly, the other end of link 72 is, via another anchor pin 76, pivotally connected to a second boss 1301 rigidly attached to the outer hub case 201.

The motion imposed by this mechanism is such that when the centrifugal forces acting on the blade mass become sufficiently high, the blades 2 move radially outward. As the blade shafts 302 move outward within sleeves 33, the bellcrank 70 is caused to move radially outward with the spherical-cylindrical joint connection to pin 4. As a result of this geometry, the bellcrank 70 is also caused to pivot as a coupler link between midlinks 71 and 72. Links 71 and 72, in turn, are caused to rotate about the anchor pins 73 and 76, respectively, relative to the two bosses 1201,1301, respectively. The relative motions of the midlinks 71 and 72 and the bellcrank 70 moves the ball 164 such that the blade pin 4 and the blade 2 are caused to rotate about the blade shaft axis Y as they translate radially outward or inward.

When positioned in the radially inward, or lowest pitch operational position, FIG. 40, the mechanism is arranged such that the anchor pin 73, the bellcrank pin 74 and the ball 164 each have their respective centers positional substantially along a straight line. When in the radially outward, highest pitch operational position shown in FIG. 41, the mechanism is arranged such that the other anchor pin 76, the bellcrank pin 75, and the ball 164 each have their respective centers positioned substantially, along a straight line. Because of the inline relationship of these pin centers, the mechanism provides a lock, or holding restraint, against any torque applied about the blade shaft 302 when positioned in either the lowest pitch position, FIG. 40, or highest pitch position, FIG. 41.

In the preferred arrangement of this embodiment shown in FIG. 40, the bellcrank 70 is in an overcenter position as defined by the angle h, when in the lowest pitch operational position. Here, the bellcrank 70 is positioned so that the center of pin 4 is radially inward from a line connecting the center of pin 73 and ball 164. This overcenter angle h provides a means for resultant forces arising from the hydrodynamic loads on the blades, to bias the blades in the radially inward, low pitch position. In a manner similar to that described for the canted cam pocket 703, a higher propeller RPM is thus required to cause the blades to move radially outward to overcome the higher hydrodynamic torque, generated when hydrodynamic forces act forward of the blade shaft axis Y. Again, this hydrodynamic force feedback has the effect of having the engine speed (RPM) accelerate to a higher RPM before a shift in blade position from a low to higher pitch angle can occur during higher power, acceleration conditions than during lower, more moderate acceleration conditions.

The propellers of this invention are preferably constructed of corrosion-resistant materials, such as aluminum and/or bronze and/or stainless steel, or other corrosion-resistant metal, or impact resistant non-metals, such as polycarbonates, acetals or reinforced polymers.

I claim:

1. A self-actuating variable pitch marine propeller comprising a hub case, drive securing means designed to secure the propeller to a rotating drive shaft on a boat propulsion system such that the propeller rotates with the drive shaft; a plurality of blades extending radially outward from the hub case, each blade comprising a hydrodynamic surface, and a blade shaft extending from the hydrodynamic surface and having a blade shaft axis extending transverse to the drive shaft axis, the center of pressure of the hydrodynamic surface being located forward of the blade shaft axis so as to generate a hydrodynamic torque on the blade tending to turn the blade, towards a higher pitch, about the blade axis when the propeller is rotated, said blade shaft being pivotally connected to the hub case, about the blade shaft axis, such that rotation of the propeller by the drive shaft generates a centrifugal reaction force tending to cause each blade to pivot about the blade axis; mechanical blade holding means mounted to the hub case, and which tends to hold the blade in one extreme pitch position until the rotational movement of the propeller generates sufficient centrifugal force effect to overcome such mechanical hold; whereby the blades are automatically movable between a first lower angle of pitch operational position, and a second higher angle of pitch operational position, as the rotational speed of the propeller increases.

2. The self-actuating variable pitch marine propeller of claim 1, comprising mechanical biasing means tending to maintain the blade in the first operational pitch position.

3. The self-actuating variable pitch marine propeller of claim 2, wherein the mechanical biasing means comprises spring biasing means.

4. The self-actuating variable pitch marine propeller of claim 3, wherein the spring biasing means comprises a compression spring operatively connected between the blade and the hub case, tending to bias the blade towards the innermost radial position.

5. The self-actuating variable pitch marine propeller of claim 1, further comprising motion-directing means and wherein the motion-directing means comprises a cam surface and a cam follower which causes simultaneous translational and rotational movement of the blade in response to the centrifugal force effect on the blade.

6. The self-actuating variable pitch marine propeller of claim 1, further comprising motion directing means comprises a first cam surface and a cam follower which interact to cause simultaneous radially outward translational movement and pitch increasing rotational movement of the blade in response to an increase in the centrifugal force effect on the blade.

7. The self-actuating variable pitch marine propeller of claim 6, wherein the blade holding means comprises a second cam surface interacting with the cam follower to cause rotational motion of the blade in opposition to the hydrodynamic torque, the second cam surface being operatively connected to the first cam surface, so that the cam follower moves between the first and second cam surfaces as the blade moves linearly radially, whereby the hydrodynamic torque acts as a a blade-biasing force to hold the blade in the first pitch position.

8. The self-actuating variable pitch marine propeller of claim 6, comprising coordination means operatively connected to each of the blades such that movement of any one of the blades causes a proportional movement of the coordination means, whereby the movement of all of the blades is synchronized.

9. The self-actuating variable pitch marine propeller of claim 8, comprising a spring bias means connected between the hub case and the coordination means so as to bias the blades towards the low pitch position.

10. The self-actuating variable pitch marine propeller of claim 1 wherein the blade holding means comprise a combined linkage system comprising a substantially rigid first pin means secured to the blade shaft; a crank link; multiple axes joining means rotatably and slidably connecting the link, at a first location, to the first pin means, to permit the first pin to pivot and to move linearly relative to the link about at least two axes transverse to the blade shaft axis; second pin means operably connected between a second location on the link and the hub case and permitting pivoting of the link relative to the hub case about an axis transverse to the blade shaft axis.

11. A self-actuating variable pitch marine propeller comprising a hub case, drive securing means designed to secure the propeller to a rotating drive shaft on a boat propulsion system such that the propeller rotates with the drive shaft; a plurality of blades extending radially outward from the hub case, each blade comprising a hydrodynamic surface and a blade shaft extending from the hydrodynamic surface along a blade axis extending transverse to the drive shaft axis, the center of pressure of the hydrodynamic surface being distant from the blade axis so as to generate a hydrodynamic torque about the blade axis when the propeller is rotated, said blade shaft being pivotally, about the blade axis, slidably connected to the hub case, such that rotation of the propeller by the drive shaft generates a centrifugal reaction force tending to cause the blades to pivot about the blade axis; motion direction means, comprising a cam surface and a cam follower, operatively connected between the hub case and a blade shaft, the cam surface having at least two portions, a first portion designed to cause such blade to move pivotally about the blade axis, and a second portion designed to prevent pivoting movement when the blade is in a first operational pitch position; whereby the second portion resists the hydrodynamic force torque generated by the blade surface, and thus tends to hold the blade in the first operational pitch position until the rotational movement of the propeller generates sufficient centrifugal force effect to cause the cam follower to move to the second portion of the cam surface, and thus to permit pivotal movement of the blade towards the second pitch position.

12. The self-actuating variable pitch marine propeller of claim 11, further comprising mechanical biasing means tending to maintain the blade in the first operational pitch position.

13. The self-actuating variable pitch marine propeller of claim 12, wherein the mechanical biasing means comprises spring biasing means.

14. The self-actuating variable pitch marine propeller of claim 11, comprising coordination means operatively connected to each of the blades such that movement of any of the blades causes a proportional movement of the coordination means, whereby the movement of all of the blades is synchronized.

15. The self-actuating variable pitch marine propeller of claim 14, comprising a spring bias means connected between the hub case and the coordination means so as to bias the blades towards the low pitch position.

* * * * *